US012085321B2

(12) United States Patent
Yajima

(10) Patent No.: US 12,085,321 B2
(45) Date of Patent: Sep. 10, 2024

(54) REFRIGERATION CYCLE SYSTEM AND REFRIGERANT RECOVERY APPARATUS

(71) Applicant: DAIKIN INDUSTRIES, LTD., Osaka (JP)

(72) Inventor: Ryuzaburo Yajima, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 0 days.

(21) Appl. No.: 18/384,652

(22) Filed: Oct. 27, 2023

(65) Prior Publication Data

US 2024/0053075 A1 Feb. 15, 2024

Related U.S. Application Data

(63) Continuation of application No. PCT/JP2022/019142, filed on Apr. 27, 2022.

(30) Foreign Application Priority Data

Apr. 30, 2021 (JP) ..... 2021-077671

(51) Int. Cl.
*F25B 49/02* (2006.01)
*F25B 13/00* (2006.01)

(52) U.S. Cl.
CPC ..... *F25B 49/02* (2013.01); *F25B 13/00* (2013.01); *F25B 2313/0233* (2013.01);
(Continued)

(58) Field of Classification Search
CPC .. F25B 49/02; F25B 13/00; F25B 2313/0233; F25B 2400/06; F25B 2400/19; F25B 2500/221
See application file for complete search history.

(56) References Cited

U.S. PATENT DOCUMENTS

2017/0299241 A1* 10/2017 Ishikawa ..... F25B 31/006
2018/0003419 A1 1/2018 Ohura et al.
(Continued)

FOREIGN PATENT DOCUMENTS

CN 106196778 A 12/2016
CN 111201411 A 5/2020
(Continued)

OTHER PUBLICATIONS

International Preliminary Report on Patentability and English translation of the Written Opinion of the International Searching Authority dated Nov. 9, 2023 for Application No. PCT/JP2022/019142.
(Continued)

*Primary Examiner* — Henry T Crenshaw
(74) *Attorney, Agent, or Firm* — Birch, Stewart, Kolasch & Birch, LLP

(57) ABSTRACT

A refrigeration cycle system includes a refrigeration cycle apparatus and a refrigerant storage portion. The refrigeration cycle apparatus includes an indoor unit, an outdoor unit, a gas-side connection pipe, and a liquid-side connection pipe. The refrigerant storage portion stores the refrigerant present inside a refrigerant circulation path. The refrigerant storage portion communicates with the refrigerant circulation path through a first storage portion pipe and a second storage portion pipe. The first storage portion pipe causes a first refrigerant pipe of an outdoor refrigerant flow path and the refrigerant storage portion to communicate with each other, or causes the gas-side connection pipe and the refrigerant storage portion to communicate with each other. The second storage portion pipe causes the second refrigerant pipe of the outdoor refrigerant flow path and the refrigerant storage portion to communicate with each other.

20 Claims, 18 Drawing Sheets

(52) U.S. Cl.
CPC ..... *F25B 2400/06* (2013.01); *F25B 2400/19* (2013.01); *F25B 2500/221* (2013.01)

(56) References Cited

U.S. PATENT DOCUMENTS

| | | | |
|---|---|---|---|
| 2018/0172329 | A1 | 6/2018 | Taira |
| 2020/0208889 | A1 | 7/2020 | Domyo |
| 2020/0240686 | A1 | 7/2020 | Yajima |
| 2020/0318875 | A1 | 10/2020 | Yamada et al. |

FOREIGN PATENT DOCUMENTS

| | | | |
|---|---|---|---|
| JP | 10-9692 | A | 1/1998 |
| JP | 2011-112233 | A | 6/2011 |
| JP | 2016-142434 | A | 8/2016 |
| JP | 2016-191530 | A | 11/2016 |
| JP | 2017-32185 | A | 2/2017 |
| JP | 2017-67398 | A | 4/2017 |
| JP | 2019-15457 | A | 1/2019 |
| JP | 2019-15461 | A | 1/2019 |
| JP | 2019-158160 | A | 9/2019 |
| JP | 2020-143870 | A | 9/2020 |
| JP | 2020-153593 | A | 9/2020 |
| KR | 10-2020-0031306 | A | 3/2020 |
| WO | WO 2013/021762 | A1 | 2/2013 |
| WO | WO 2016/051493 | A1 | 4/2016 |
| WO | WO 2019/064566 | A1 | 4/2019 |

OTHER PUBLICATIONS

International Search Report for PCT/JP2022/019142 (PCT/ISA/210) mailed on Jul. 19, 2022.

* cited by examiner

REFRIGERATION CYCLE SYSTEM AND REFRIGERANT RECOVERY APPARATUS

CROSS REFERENCE TO RELATED APPLICATIONS

This application is a Continuation of PCT International Application No. PCT/JP2022/019142, filed on Apr. 27, 2022, which claims priority under 35 U.S.C. § 119(a) to Patent Application No. JP 2021-077671, filed in Japan on Apr. 30, 2021, all of which are hereby expressly incorporated by reference into the present application.

TECHNICAL FIELD

The present invention relates to a refrigeration cycle system and a refrigerant recovery apparatus.

BACKGROUND ART

Patent Literature 1 (JP H10-009692 A) discloses an air conditioner (refrigeration cycle apparatus) that recovers a refrigerant of an indoor unit into an outdoor unit when leakage of the refrigerant is detected in the indoor unit.

SUMMARY

A refrigeration cycle system includes a refrigeration cycle apparatus and a refrigerant storage portion. The refrigeration cycle apparatus includes an indoor unit having an indoor refrigerant flow path, an outdoor unit having an outdoor refrigerant flow path, and a gas-side connection pipe and a liquid-side connection pipe that connect the indoor refrigerant flow path and the outdoor refrigerant flow path. The refrigerant storage portion stores a refrigerant present inside a refrigerant circulation path formed by the indoor refrigerant flow path, the outdoor refrigerant flow path, the gas-side connection pipe, and the liquid-side connection pipe.

The outdoor refrigerant flow path has: a first compressor; an outdoor heat exchanger; an outdoor expansion mechanism; a flow path switching mechanism; a gas-side connecting portion to which the gas-side connection pipe is connected; a liquid-side connecting portion to which the liquid-side connection pipe is connected; a first refrigerant pipe that connects the outdoor expansion mechanism and the gas-side connecting portion; a second refrigerant pipe that connects the outdoor heat exchanger and the outdoor expansion mechanism; and a third refrigerant pipe that connects the outdoor expansion mechanism and the liquid-side connecting portion. The refrigerant storage portion communicates with the refrigerant circulation path through a first pipe and a second pipe. The first pipe causes the first refrigerant pipe and the refrigerant storage portion to communicate with each other, or causes the gas-side connection pipe and the refrigerant storage portion to communicate with each other. The second pipe causes the second refrigerant pipe and the refrigerant storage portion to communicate with each other.

DESCRIPTION OF EMBODIMENTS

First Embodiment

(1) Overall Configuration

Figure 1:
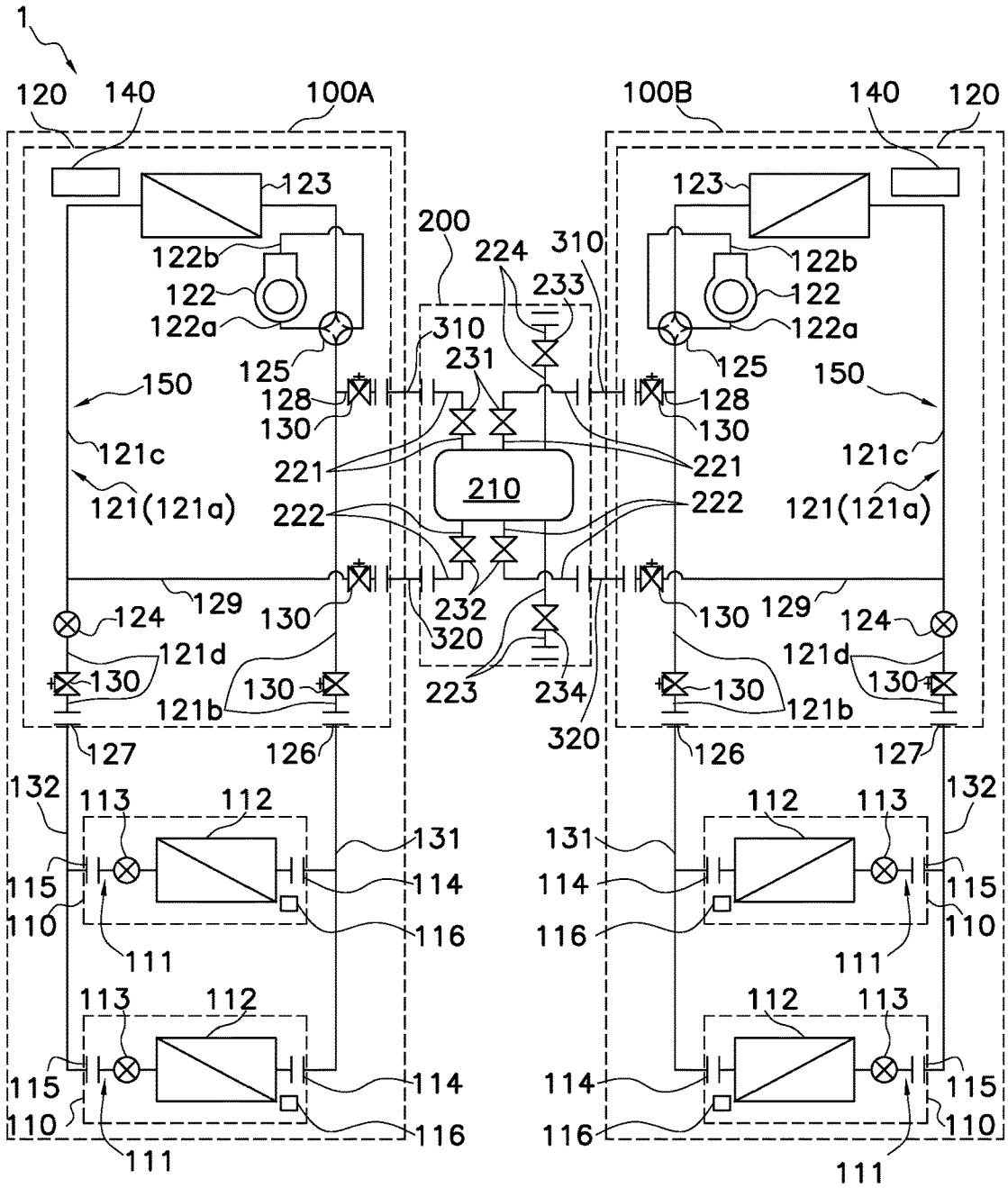
FIG. 1 is a schematic configuration diagram illustrating a refrigeration cycle system 1.
Figure 2:
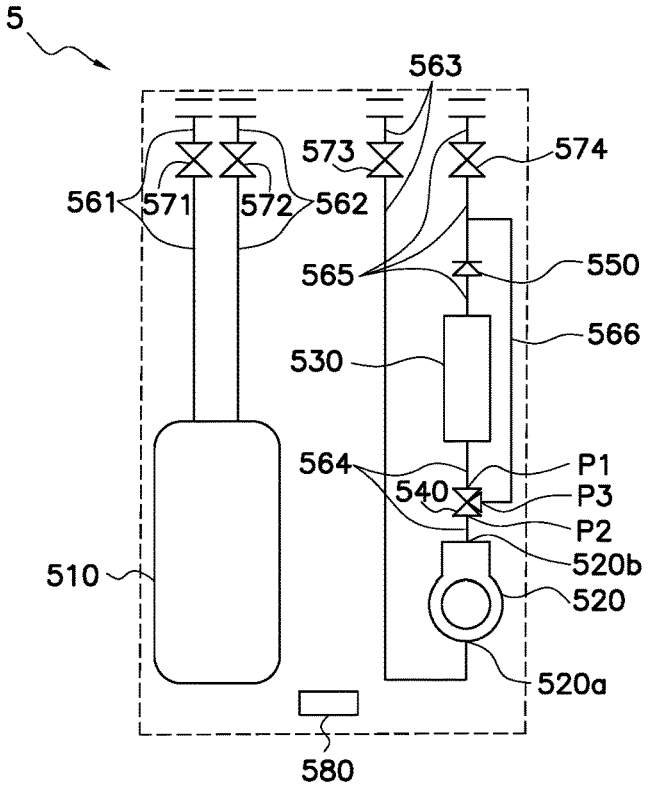
FIG. 2 is a schematic configuration diagram illustrating a refrigerant recovery apparatus 5.

A refrigeration cycle system 1 and a refrigerant recovery apparatus 5 according to a first embodiment of the present disclosure will be described. FIG. 1 is a schematic configuration diagram illustrating the refrigeration cycle system 1. FIG. 2 is a schematic configuration diagram illustrating the refrigerant recovery apparatus 5.

The refrigeration cycle system 1 includes a refrigeration cycle apparatus 100A, a refrigeration cycle apparatus 100B, one refrigerant storage portion 200, two first connecting pipes 310, and two second connecting pipes 320. The refrigerant storage portion 200 stores a refrigerant made to fill the refrigeration cycle apparatuses 100A and 100B. Each refrigeration cycle apparatus 100 communicates with the refrigerant storage portion 200 through the first connecting pipe 310 and the second connecting pipe 320.

FIG. 1 illustrates a state where the refrigerant storage portion 200 is attached to the refrigeration cycle apparatuses 100A and 100B. Note that the number of refrigeration cycle apparatuses 100 included in the refrigeration cycle system 1 is not limited to two, and may be one or three or more.

The refrigeration cycle apparatuses 100A and 100B have similar devices and have similar functions. Therefore, in the following description common to the refrigeration cycle apparatuses 100A and 100B, the description will be made as the refrigeration cycle apparatus 100. In the description in which requiring distinction between the refrigeration cycle apparatuses 100A and 100B, "A" or "B" is added to reference numerals of devices constituting the refrigeration cycle apparatuses 100A and 100B for distinction.

The refrigerant recovery apparatus 5 recovers a refrigerant stored in the refrigerant storage portion 200. The refrigerant recovery apparatus 5 is connected to the refrigeration cycle system 1 by a refrigerant recovery connecting pipe 600.

Note that, in the following description, the same reference numerals are given to the same or corresponding configurations in the individual embodiments and modifications, and a description thereof is appropriately omitted.

(2) Detailed Configuration

(2-1) Refrigeration Cycle System

(2-1-1) Refrigeration Cycle Apparatus

The refrigeration cycle apparatus 100 is an air conditioner that cools and heats an air conditioning target space (not illustrated) by using a vapor compression refrigeration cycle. The refrigeration cycle apparatus 100 has an indoor unit 110, an outdoor unit 120, a gas-side connection pipe 131, a liquid-side connection pipe 132, and a first control unit 140. The refrigeration cycle apparatus 100 is a multi-type air conditioner for a building and has two indoor units 110. The number of the indoor units 110 included in the refrigeration cycle apparatus 100 is not limited to two, and may be one or three or more.

Although details will be described later, the indoor unit 110 has an indoor refrigerant flow path 111, and the outdoor unit 120 has an outdoor refrigerant flow path 121. The indoor refrigerant flow path 111, the outdoor refrigerant flow path 121, the gas-side connection pipe 131, and the liquid-side connection pipe 132 form a refrigerant circulation path 150. The refrigerant circulation path 150 is filled with a refrigerant. The refrigerant made to fill the refrigerant circulation path 150 is not limited, but is, for example, a fluorocarbon-based refrigerant such as R32 having lower flammability (A2L). The refrigerant may have flammability or toxicity. Note that, the refrigeration cycle apparatus 100 is not limited to the air conditioner, and may be, for example, a refrigerator, a freezer, a water heater, a floor heating apparatus, or the like.

(2-1-1-1) Indoor Unit

The indoor unit 110 is installed in the air conditioning target space. The indoor unit 110 has the indoor refrigerant flow path 111 and a detection unit 116.

The indoor refrigerant flow path 111 constitutes a part of the refrigerant circulation path 150. The indoor refrigerant flow path 111 is formed by connecting an indoor heat exchanger 112 and an indoor expansion mechanism 113 via a refrigerant pipe.

The indoor heat exchanger 112 exchanges heat between a refrigerant flowing inside the indoor heat exchanger 112 and air in the air conditioning target space. The indoor heat exchanger 112 functions as an evaporator of the refrigerant during a cooling operation, and functions as a radiator of the refrigerant during a heating operation. One end of the indoor heat exchanger 112 is connected to a gas-side connecting portion 114 via a refrigerant pipe. Another end of the indoor heat exchanger 112 is connected to the indoor expansion mechanism 113 via a refrigerant pipe.

The indoor expansion mechanism 113 adjusts a pressure and a flow rate of a refrigerant flowing through the refrigerant circulation path 150. The indoor expansion mechanism 113 is an electronic expansion valve whose opening degree is adjusted by an actuator (not illustrated). The indoor expansion mechanism 113 is connected to the indoor heat exchanger 112 and a liquid-side connecting portion 115 via a refrigerant pipe. An opening degree of the indoor expansion mechanism 113 is controlled by the first control unit 140.

The gas-side connecting portion 114 is one end of the indoor refrigerant flow path 111. The gas-side connecting portion 114 is connected to the gas-side connection pipe 131.

The liquid-side connecting portion 115 is another end of the indoor refrigerant flow path 111. The liquid-side connecting portion 115 is connected to the liquid-side connection pipe 132.

The detection unit 116 detects leakage of a refrigerant from the refrigerant circulation path 150. The detection unit 116 is installed inside a casing (not illustrated) of the indoor unit 110. The detection unit 116 is not limited in terms of mode as long as leakage of the refrigerant from the refrigerant circulation path 150 is detected, and may be a sensor that detects the refrigerant, or may detect leakage of the refrigerant through a sudden change in an air temperature inside the casing of the indoor unit 110 or a temperature of the pipe. After the detection unit 116 detects leakage of the refrigerant, the detection unit 116 transmits a signal indicating the leakage of the refrigerant to the first control unit 140.

(2-1-1-2) Outdoor Unit

The outdoor unit 120 is disposed outside the air conditioning target space. The outdoor unit 120 is installed, for example, on a rooftop of a building where the refrigeration cycle apparatus 100 is installed or adjacent to the building. The outdoor unit 120 has the outdoor refrigerant flow path 121, a gas-side branch pipe 128, a liquid-side branch pipe 129, and an outdoor refrigerant flow path shutoff valve 130.

The outdoor refrigerant flow path 121 constitutes a part of the refrigerant circulation path 150. The outdoor refrigerant flow path 121 is formed by connecting, via a refrigerant pipe 121*a*, a first compressor 122, an outdoor heat exchanger 123, an outdoor expansion mechanism 124, a flow path switching mechanism 125, a gas-side connecting portion 126, and a liquid-side connecting portion 127. The refrigerant pipe 121*a* includes a first refrigerant pipe 121*b*, a second refrigerant pipe 121*c*, and a third refrigerant pipe 121*d*.

The first compressor 122 suctions a low-pressure refrigerant in the refrigeration cycle from a suction pipe 122*a*, compresses the refrigerant by a compression mechanism (not illustrated), and discharges the compressed refrigerant to a discharge pipe 122*b*. The operation of the first compressor 122 is controlled by the first control unit 140.

The outdoor heat exchanger 123 exchanges heat between the refrigerant flowing inside the outdoor heat exchanger 123 and air (heat source air) at an installation location of the outdoor unit 120. The outdoor heat exchanger 123 functions as a radiator of the refrigerant during the cooling operation, and functions as an evaporator of the refrigerant during the heating operation. One end of the outdoor heat exchanger 123 is connected to the flow path switching mechanism 125 via a refrigerant pipe. Another end of the outdoor heat exchanger 123 is connected to the outdoor expansion mechanism 124 via a refrigerant pipe.

The outdoor expansion mechanism 124 adjusts a pressure and a flow rate of the refrigerant flowing through the refrigerant circulation path 150. The outdoor expansion mechanism 124 is an electronic expansion valve whose opening degree is adjusted by an actuator (not illustrated). An opening degree of the indoor expansion mechanism 113 is controlled by the first control unit 140. The outdoor expansion mechanism 124 is connected to the outdoor heat exchanger 123 and the liquid-side connecting portion 127 via a refrigerant pipe.

The flow path switching mechanism 125 changes a state of the refrigerant circulation path 150 between a first state and a second state by switching a flow direction of the refrigerant. When the refrigerant circulation path 150 is in the first state, the outdoor heat exchanger 123 functions as a radiator of the refrigerant, and the indoor heat exchanger 112 functions as an evaporator of the refrigerant. When the refrigerant circulation path 150 is in the second state, the outdoor heat exchanger 123 functions as an evaporator of the refrigerant, and the indoor heat exchanger 112 functions as a radiator of the refrigerant. The flow path switching mechanism 125 is controlled by the first control unit 140. The flow path switching mechanism 125 according to the present embodiment is configured as a four-way switching valve. However, the flow path switching mechanism 125 is not limited to the four-way switching valve. For example, the flow path switching mechanism 125 may be configured by combining a plurality of electromagnetic valves and refrigerant pipes so that the following switching of the flow direction of the refrigerant can be realized.

During the cooling operation, the flow path switching mechanism 125 sets a state of the refrigerant circulation path 150 to the first state. In other words, during the cooling operation, the flow path switching mechanism 125 causes the suction pipe 122*a* to communicate with the gas-side connecting portion 126, and causes the discharge pipe 122*b* to communicate with the outdoor heat exchanger 123 (see a broken line in the flow path switching mechanism 125 in FIG. 1). During the heating operation, the flow path switching mechanism 125 sets a state of the refrigerant circulation path 150 to the second state. In other words, during the heating operation, the flow path switching mechanism 125 causes the suction pipe 122*a* to communicate with the outdoor heat exchanger 123, and causes the discharge pipe 122*b* to communicate with the gas-side connecting portion 126 (see a solid line in the flow path switching mechanism 125 in FIG. 1).

The gas-side connecting portion 126 is one end of the outdoor refrigerant flow path 121. The gas-side connection pipe 131 is connected to the gas-side connecting portion 126.

The liquid-side connecting portion 127 is another end of the outdoor refrigerant flow path 121. The liquid-side connection pipe 132 is connected to the liquid-side connecting portion 127.

The first refrigerant pipe 121*b* connects the flow path switching mechanism 125 and the gas-side connecting portion 126.

The second refrigerant pipe 121*c* connects the outdoor heat exchanger 123 and the outdoor expansion mechanism 124.

The third refrigerant pipe 121*d* connects the outdoor expansion mechanism 124 and the liquid-side connecting portion 127.

The gas-side branch pipe 128 is a pipe that causes the first refrigerant pipe 121*b* and the refrigerant storage portion 200 to communicate with each other. In the present embodiment, one end of the gas-side branch pipe 128 is connected to the first refrigerant pipe 121*b*. Another end of the gas-side branch pipe 128 communicates with a first storage portion pipe 221 via the first connecting pipe 310.

The liquid-side branch pipe 129 is a pipe that causes the second refrigerant pipe 121*c* and the refrigerant storage portion 200 to communicate with each other. In the present embodiment, one end of the liquid-side branch pipe 129 is connected to the second refrigerant pipe 121*c*. Another end of the liquid-side branch pipe 129 communicates with a second storage portion pipe 222 via the second connecting pipe 320.

The outdoor refrigerant flow path shutoff valve 130 is provided at a predetermined position of the outdoor refrigerant flow path 121, the gas-side branch pipe 128, or the liquid-side branch pipe 129, and allows or interrupts communication of the outdoor refrigerant flow path 121, the gas-side branch pipe 128, or the liquid-side branch pipe 129. The outdoor refrigerant flow path shutoff valve 130 is manually controlled to open and close. The outdoor refrigerant flow path shutoff valve 130 is closed to prevent leakage of a refrigerant sealed in the outdoor unit 120 to an outside, for example, when the refrigeration cycle apparatus 100 is installed, and the like. The outdoor refrigerant flow path shutoff valve 130 is opened after the refrigeration cycle apparatus 100 is installed.

The refrigeration cycle apparatus 100 includes four outdoor refrigerant flow path shutoff valves 130. The outdoor refrigerant flow path shutoff valve 130 is provided in the first refrigerant pipe 121*b*, the third refrigerant pipe 121*d*, the gas-side branch pipe 128, and the liquid-side branch pipe 129.

(2-1-1-3) Gas-Side Connection Pipe and Liquid-Side Connection Pipe

The gas-side connection pipe 131 and the liquid-side connection pipe 132 connect the indoor refrigerant flow path 111 and the outdoor refrigerant flow path 121.

The gas-side connection pipe 131 is connected to the gas-side connecting portion 114 of the indoor refrigerant flow path 111 and the gas-side connecting portion 126 of the outdoor refrigerant flow path 121.

The liquid-side connection pipe 132 is connected to the liquid-side connecting portion 115 of the indoor refrigerant flow path 111 and the liquid-side connecting portion 127 of the outdoor refrigerant flow path 121.

(2-1-1-4) First Control Unit

Figure 3:
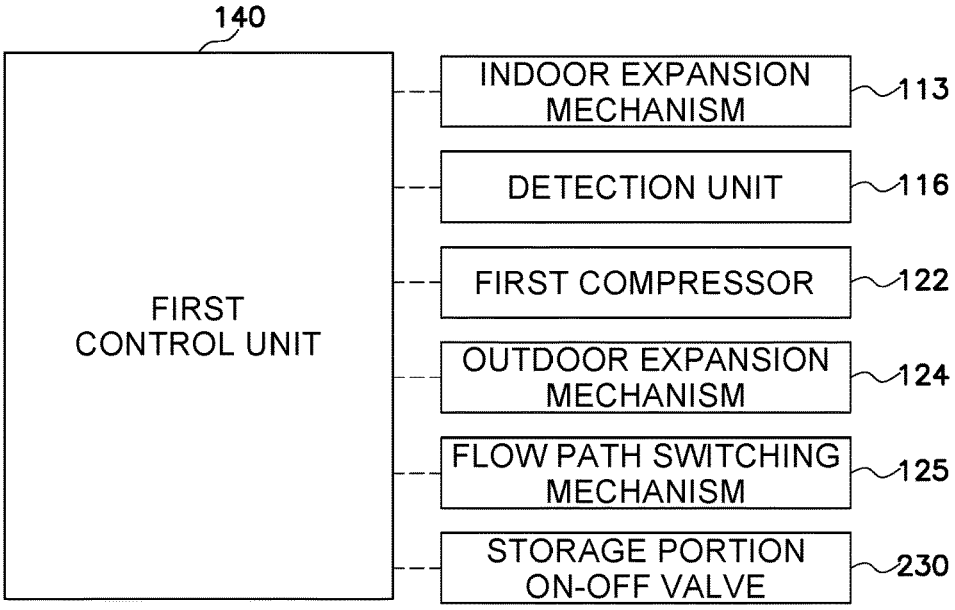
FIG. 3 is a control block diagram of a first control unit 140.

The first control unit 140 controls operations of individual parts constituting the refrigeration cycle apparatus 100 and the refrigerant storage portion 200. The first control unit 140 is electrically connected to the indoor expansion mechanism 113, the detection unit 116, the first compressor 122, the outdoor expansion mechanism 124, the flow path switching mechanism 125, and a storage portion on-off valve 230 to be described later, so as to be able to exchange control signals and information. FIG. 3 is a control block diagram of the first control unit 140. In the present embodiment, the first control unit 140 is installed inside a casing (not illustrated) of the outdoor unit 120. An installation location of the first control unit 140 is not limited, and may be other than the inside of the casing of the outdoor unit 120.

The first control unit 140 controls operations of the individual parts constituting the refrigeration cycle apparatus 100 and the refrigerant storage portion 200, to execute an air conditioning operation, a refrigerant storage operation, and a refrigerant filling operation. The air conditioning operation includes the cooling operation and the heating operation. The refrigerant storage operation is an operation for storing a refrigerant present in the refrigerant circulation path 150 into the refrigerant storage portion 200. The refrigerant filling operation is an operation for making the refrigerant stored in the refrigerant storage portion 200 to fill the refrigerant circulation path 150.

The refrigeration cycle apparatus 100A includes a first control unit 140A, and the refrigeration cycle apparatus 100B includes a first control unit 140B. Since the first control unit 140A and the first control unit 140B execute the air conditioning operation, the refrigerant storage operation, and the refrigerant filling operation in cooperation with each other, hereinafter, the first control unit 140A and the first control unit 140B are collectively referred to as the first control unit 140.

Control of the refrigeration cycle apparatus 100 during the cooling operation and the heating operation will be described. The refrigerant storage operation and the refrigerant filling operation will be described later in detail.

(Cooling Operation)

When execution of the cooling operation is instructed to the refrigeration cycle apparatus 100, the first control unit 140 controls the flow path switching mechanism 125 to be in a state indicated by a broken line in FIG. 1 to set a state of the refrigerant circulation path 150 to the above-described first state, and operates the first compressor 122.

When the first compressor 122 is operated, a low-pressure gas refrigerant in the refrigeration cycle is compressed into a high-pressure gas refrigerant in the refrigeration cycle. The high-pressure gas refrigerant is sent to the outdoor heat exchanger 123 via the flow path switching mechanism 125, and exchanges heat with the heat source air to be condensed into a high-pressure liquid refrigerant. The high-pressure liquid refrigerant is sent to the indoor unit 110 via the indoor expansion mechanism 113 that is fully opened and the liquid-side connection pipe 132. The refrigerant in a gas-liquid two-phase state sent to the indoor unit 110 is decompressed to a pressure close to a suction pressure of the first compressor 122 in the indoor expansion mechanism 113 having a reduced opening degree, becomes the refrigerant in the gas-liquid two-phase state, and is sent to the indoor heat exchanger 112. The refrigerant in the gas-liquid two-phase state exchanges heat with air in the air conditioning target space in the indoor heat exchanger 112 and evaporates to become a low-pressure gas refrigerant. The low-pressure gas refrigerant is sent to the outdoor unit 120 via the gas-side connection pipe 131, and suctioned again into the first compressor 122 via the flow path switching mechanism 125. A temperature of air supplied to the indoor heat exchanger 112 decreases by heat exchange with the refrigerant flowing through the indoor heat exchanger 112. The air cooled by the indoor heat exchanger 112 is blown out into the air conditioning target space.

(Heating Operation)

When execution of the heating operation is instructed to the refrigeration cycle apparatus 100, the first control unit 140 controls the flow path switching mechanism 125 to be in a state indicated by a solid line in FIG. 1 to set a state of the refrigerant circulation path 150 to the above-described second state, and operates the first compressor 122.

When the first compressor 122 is operated, a low-pressure gas refrigerant in the refrigeration cycle is compressed into a high-pressure gas refrigerant in the refrigeration cycle. The high-pressure gas refrigerant is sent to the indoor unit 110 via the flow path switching mechanism 125 and the gas-side connection pipe 131. The refrigerant sent to the indoor unit 110 is sent to the indoor heat exchanger 112, and exchanges heat with air in the air conditioning target space to be condensed into a high-pressure liquid refrigerant. A temperature of air supplied to the indoor heat exchanger 112 rises by heat exchange with the refrigerant flowing through the indoor heat exchanger 112. The air heated by the indoor heat exchanger 112 is blown out into the air conditioning target space. The high-pressure liquid refrigerant flowing out of the indoor heat exchanger 112 is sent to the outdoor unit 120 via the indoor expansion mechanism 113 that is fully opened and the liquid-side connection pipe 132. The refrigerant sent to the outdoor unit 120 is decompressed to a pressure close to a suction pressure of the first compressor 122 in the outdoor expansion mechanism 124 having a reduced opening degree, and becomes the refrigerant in a gas-liquid two-phase state and is sent to the outdoor heat exchanger 123. The refrigerant in the gas-liquid two-phase state exchanges heat with the heat source air in the outdoor heat exchanger 123 and evaporates to become a low-pressure gas refrigerant. The low-pressure gas refrigerant is suctioned into the first compressor 122 again via the flow path switching mechanism 125.

The first control unit 140 is implemented by a computer. The first control unit 140 includes a control arithmetic device and a storage device (neither illustrated). Examples of the control arithmetic device can include a processor such as a CPU or a GPU. The control arithmetic device reads a program from the storage device, and executes predetermined image processing and arithmetic processing in accordance with this program. The control arithmetic device is further configured to write an arithmetic result to the storage device, and read information stored in the storage device, in accordance with the program. The storage device can be used as database. Specific functions implemented by the first control unit 140 will be described later.

Note that the configuration of the first control unit 140 described here is merely an example, and the function of the first control unit 140 described below may be implemented by software, hardware, or a combination of software and hardware.

(2-1-2) Refrigerant Storage Portion

The refrigerant storage portion 200 stores a refrigerant present in the refrigerant circulation path 150 by a storage operation to be described later, and fills the refrigerant circulation path 150 with the refrigerant stored, by a filling operation to be described later. The refrigerant storage portion 200 is connected to the refrigeration cycle apparatus 100. The refrigerant storage portion 200 has a storage container 210, a storage portion pipe 220, and the storage portion on-off valve 230.

In the following description, in the description requiring distinction between: the storage portion pipe 220 and the storage portion on-off valve 230 for storage of the refrigerant of the refrigeration cycle apparatus 100A; and the storage portion pipe 220 and the storage portion on-off valve 230 for storage of the refrigerant of the refrigeration cycle apparatus 100B, "A" or "B" is added to each reference numeral for distinction.

(2-1-2-1) Storage Container

The storage container 210 is a container for storage of a refrigerant made to fill the refrigeration cycle apparatus 100.

(2-1-2-2) Storage Portion On-Off Valve

The storage portion on-off valve 230 is provided in the storage portion pipe 220. The storage portion on-off valve 230 allows or interrupts communication of the storage portion pipe 220. The storage portion on-off valve 230 is an electromagnetic on-off valve, and is controlled to be opened and closed by the first control unit 140.

The storage portion on-off valve 230 includes a first storage portion on-off valve 231, a second storage portion on-off valve 232, a third storage portion on-off valve 233, and a fourth storage portion on-off valve 234.

The first storage portion on-off valve 231 is an example of a first on-off valve. The second storage portion on-off valve 232 is an example of a second on-off valve.

(2-1-2-3) Storage Portion Pipe

The storage portion pipe 220 includes the first storage portion pipe 221, the second storage portion pipe 222, a third storage portion pipe 223, and a fourth storage portion pipe 224.

The first storage portion pipe 221 is a pipe to cause the first refrigerant pipe 121*b* of the outdoor refrigerant flow path 121 and the storage container 210 to communicate with each other. One end of the first storage portion pipe 221 is connected to the storage container 210. Another end of the first storage portion pipe 221 is connected to the gas-side branch pipe 128 via the first connecting pipe 310. The first storage portion pipe 221 is provided with the first storage portion on-off valve 231. The first storage portion pipe 221 is an example of a first pipe.

The second storage portion pipe 222 is a pipe to cause the second refrigerant pipe 121*c* of the outdoor refrigerant flow path 121 and the storage container 210 to communicate with each other. One end of the second storage portion pipe 222 is connected to the storage container 210. Another end of the second storage portion pipe 222 is connected to the liquid-side branch pipe 129 via the second connecting pipe 320. The second storage portion pipe 222 is provided with the second storage portion on-off valve 232. The second storage portion pipe 222 is an example of a second pipe.

The third storage portion pipe 223 is a pipe to cause the refrigerant recovery apparatus 5 to communicate with the storage container 210. One end of the third storage portion pipe 223 is connected to the storage container 210. Another end of the third storage portion pipe 223 is connected to the refrigerant recovery connecting pipe 600 at a time of the refrigerant storage operation and the refrigerant filling operation described later. The third storage portion pipe 223 is provided with the fourth storage portion on-off valve 234.

The fourth storage portion pipe 224 is a pipe to cause the refrigerant recovery apparatus 5 to communicate with the storage container 210. One end of the fourth storage portion pipe 224 is connected to the storage container 210. Another end of the fourth storage portion pipe 224 is connected to the refrigerant recovery connecting pipe 600 at a time of the refrigerant storage operation described later. The fourth storage portion pipe 224 is provided with the third storage portion on-off valve 233.

(2-1-3) First Connecting Pipe

The first connecting pipe 310 is a pipe that cause the first refrigerant pipe 121*b* and the first storage portion pipe 221 to communicate with each other. One end of the first connecting pipe 310 is connected to the gas-side branch pipe 128. Another end of the first connecting pipe 310 is connected to the first storage portion pipe 221.

(2-1-4) Second Connecting Pipe

The second connecting pipe 320 is a pipe that causes the second refrigerant pipe 121*c* and the second storage portion pipe 222 to communicate with each other. One end of the second connecting pipe 320 is connected to the liquid-side branch pipe 129. Another end of the second connecting pipe 320 is connected to the second storage portion pipe 222.

(2-2) Refrigerant Recovery Apparatus

The refrigerant recovery apparatus 5 stores a refrigerant made to fill the refrigeration cycle apparatus 100 by the refrigerant recovery operation to be described later. The refrigerant recovery apparatus 5 has a recovery container 510, a second compressor 520, a heat exchanger 530, a switching valve 540, a check valve 550, a recovery apparatus pipe 560, a recovery apparatus on-off valve 570, and a second control unit 580.

(2-2-1) Recovery Container

The recovery container 510 is a container for recovery of a refrigerant present in the refrigerant circulation path 150 of the refrigeration cycle system 1. The recovery container 510 is, for example, a cylinder for recovery of the refrigerant. The recovery container 510 may be detachable from the refrigerant recovery apparatus 5.

(2-2-2) Compressor

The second compressor 520 suctions a refrigerant from a suction pipe 520*a*, compresses the refrigerant by a compression mechanism (not illustrated), and discharges the compressed refrigerant to a discharge pipe 520*b*. The operation of the second compressor 520 is controlled by the second control unit 580.

(2-2-3) Heat Exchanger

The heat exchanger 530 exchanges heat between a refrigerant flowing inside the heat exchanger 530 and air at an installation location of the refrigerant recovery apparatus 5. The heat exchanger 530 functions as a radiator that condenses a gas refrigerant into a liquid refrigerant in a second refrigerant recovery operation to be described later. Note that, in order to promote heat exchange in the heat exchanger 530, the refrigerant recovery apparatus 5 may further has a blower fan that blows air to the heat exchanger 530.

(2-2-4) Switching Valve

The switching valve 540 is a three-way valve having a first port P1, a second port P2, and a third port P3. The switching valve 540 is switched between three states including the first state in which the first port P1 and the second port P2 communicate with each other, the second state in which the first port P1 and the third port P3 communicate with each other, and a third state in which the second port P2 and the third port P3 communicate with each other. The switching valve 540 is controlled by the second control unit 580.

(2-2-5) Check Valve

The check valve 550 is provided in the recovery apparatus pipe 560. The check valve 550 is a valve that restricts a flow from one end to another end of the recovery apparatus pipe 560 and allows the flow from the another end to the one end.

(2-2-6) Recovery Apparatus On-Off Valve

The recovery apparatus on-off valve 570 is provided in the recovery apparatus pipe 560. The recovery apparatus on-off valve 570 allows or interrupts communication of the recovery apparatus pipe 560. The recovery apparatus on-off valve 570 is an electromagnetic on-off valve, and is controlled to be opened and closed by the second control unit 580.

The recovery apparatus on-off valve 570 includes a first recovery apparatus on-off valve 571, a second recovery apparatus on-off valve 572, a third recovery apparatus on-off valve 573, and a fourth recovery apparatus on-off valve 574.

(2-2-7) Recovery Apparatus Pipe

The recovery apparatus pipe 560 includes a first recovery apparatus pipe 561, a second recovery apparatus pipe 562, a third recovery apparatus pipe 563, a fourth recovery apparatus pipe 564, a fifth recovery apparatus pipe 565, and a sixth recovery apparatus pipe 566.

One end of the first recovery apparatus pipe 561 is connected to the recovery container 510. Another end of the first recovery apparatus pipe 561 is connected to the refrigerant recovery connecting pipe 600 at a time of the refrigerant storage operation and the refrigerant filling operation described later. The first recovery apparatus pipe 561 is provided with the first recovery apparatus on-off valve 571.

One end of the second recovery apparatus pipe 562 is connected to the recovery container 510. Another end of the second recovery apparatus pipe 562 is connected to the refrigerant recovery connecting pipe 600 at a time of the first refrigerant recovery operation to be described later. The second recovery apparatus pipe 562 is provided with the second recovery apparatus on-off valve 572.

One end of the third recovery apparatus pipe 563 is connected to the suction pipe 520*a* of the second compressor 520. Another end of the third recovery apparatus pipe 563 is connected to the refrigerant recovery connecting pipe 600 at a time of the refrigerant storage operation and the refrigerant filling operation described later. The third recovery apparatus pipe 563 is provided with the third recovery apparatus on-off valve 573.

One end of the fourth recovery apparatus pipe 564 is connected to the discharge pipe 520*b* of the second compressor 520. Another end of the fourth recovery apparatus pipe 564 is connected to one end of the heat exchanger 530. The fourth recovery apparatus pipe 564 is provided with the switching valve 540. The fourth recovery apparatus pipe 564 is connected to the first port P1 and the second port P2 of the switching valve 540. The switching valve 540 causes the discharge pipe 520*b* of the second compressor 520 to selectively communicate with the sixth recovery apparatus pipe 566 and the heat exchanger 530.

One end of the fifth recovery apparatus pipe 565 is connected to another end of the heat exchanger 530. Another end of the fifth recovery apparatus pipe 565 is connected to the refrigerant recovery connecting pipe 600 at a time of the refrigerant storage operation and the refrigerant filling operation described later. The fifth recovery apparatus pipe 565 is provided with the check valve 550. The check valve 550 restricts a flow of a refrigerant from an end portion connected to the refrigerant recovery connecting pipe 600 to an end portion to which the heat exchanger 530 is connected, and allows a flow from the end portion to which the heat exchanger 530 is connected to the end portion connected to the refrigerant recovery connecting pipe 600. The fourth recovery apparatus on-off valve 574 is provided at an end portion of the fifth recovery apparatus pipe 565 connected to the refrigerant recovery connecting pipe 600.

One end of the sixth recovery apparatus pipe 566 is connected to the third port P3 of the switching valve 540. Another end of the sixth recovery apparatus pipe 566 is connected between the check valve 550 and an end portion connected to the refrigerant recovery connecting pipe 600. In other words, the sixth recovery apparatus pipe 566 is connected in parallel to the heat exchanger 530 and the check valve 550.

(2-2-8) Second Control Unit

Figure 4:
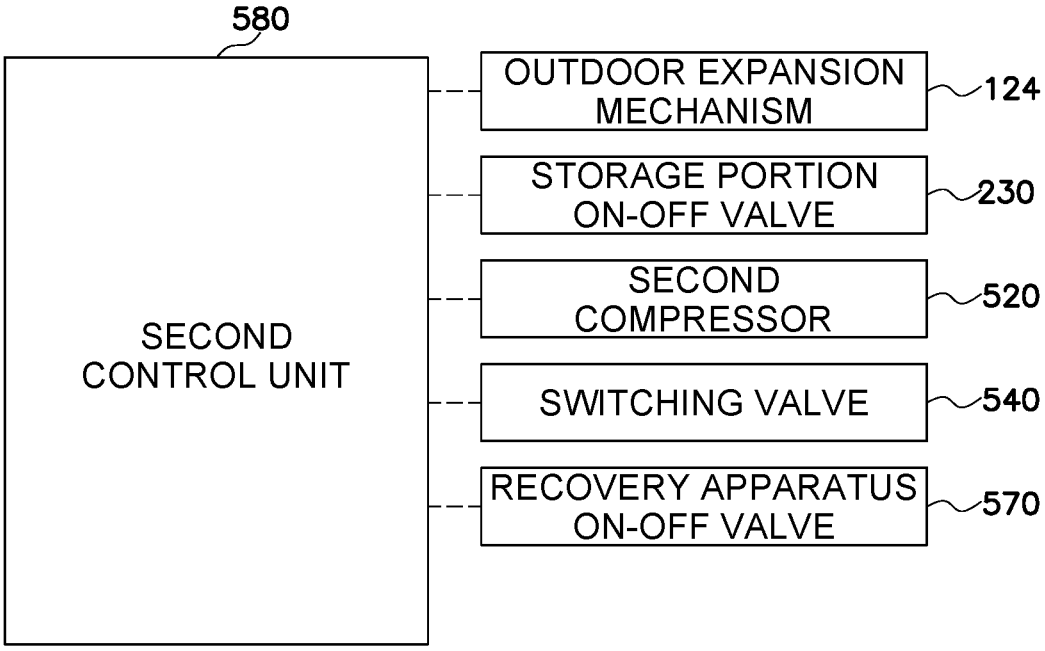
FIG. 4 is a control block diagram of a second control unit 580.

The second control unit 580 cooperates with the first control unit 140 of the refrigeration cycle system 1 and controls an operation of each part constituting the refrigerant recovery apparatus 5. The second control unit 580 is electrically connected to the outdoor expansion mechanism 124 of the refrigeration cycle system 1, the storage portion on-off valve 230, the second compressor 520, the switching valve 540, and the recovery apparatus on-off valve 570, so as to be able to exchange control signals and information. FIG. 4 is a control block diagram of the second control unit 580. In the present embodiment, the second control unit 580 is installed inside a casing (not illustrated) of the refrigerant recovery apparatus 5. An installation location of the second control unit 580 is not limited, and may be other than the inside of the casing of the refrigerant recovery apparatus 5.

The second control unit 580 cooperates with the first control unit 140 and controls operations of the individual parts constituting the refrigeration cycle system 1 and the refrigerant recovery apparatus 5, to execute the refrigerant recovery operation. The refrigerant recovery operation is an operation for recovery of a refrigerant recovered in the refrigerant storage portion 200 into the refrigerant recovery apparatus 500. Details of the refrigerant recovery operation will be described later.

The second control unit 580 is implemented by a computer. The second control unit 580 includes a control arithmetic device and a storage device (neither illustrated). Examples of the control arithmetic device can include a processor such as a CPU or a GPU. The control arithmetic device reads a program from the storage device, and executes predetermined image processing and arithmetic processing in accordance with this program. The control arithmetic device is further configured to write an arithmetic result to the storage device, and read information stored in the storage device, in accordance with the program. The storage device can be used as database. Specific functions implemented by the second control unit 580 will be described later.

Note that the configuration of the second control unit 580 described here is merely an example, and the function of the second control unit 580 described below may be implemented by software, hardware, or a combination of software and hardware.

(3) Operation (3-1) Operation of Refrigeration Cycle System

The refrigerant storage operation and the refrigerant filling operation executed by the first control unit 140 of the refrigeration cycle apparatus 100 will be described.

(3-1-1) Refrigerant Storage Operation

The refrigerant storage operation is an operation for storing a refrigerant present in the refrigerant circulation path 150 into the refrigerant storage portion 200. The refrigerant storage operation is executed, for example, to prevent further leakage of a refrigerant when the refrigerant leaks from the refrigerant circulation path 150. The first control unit 140 starts the refrigerant storage operation in response to, for example, reception of a signal indicating leakage of a refrigerant and transmitted from the detection unit 116 having detected the leakage of the refrigerant. In the following description, a case will be described as an example in which the refrigerant leaks from an indoor heat exchanger 112A in one indoor unit 110A of the refrigeration cycle apparatus 100A. The refrigerant storage operation includes a first refrigerant storage operation and a second refrigerant storage operation executed after an end of the first refrigerant storage operation. The first refrigerant storage operation is an example of first control. The second refrigerant storage operation is an example of second control.

(First Refrigerant Storage Operation)

Figure 5:
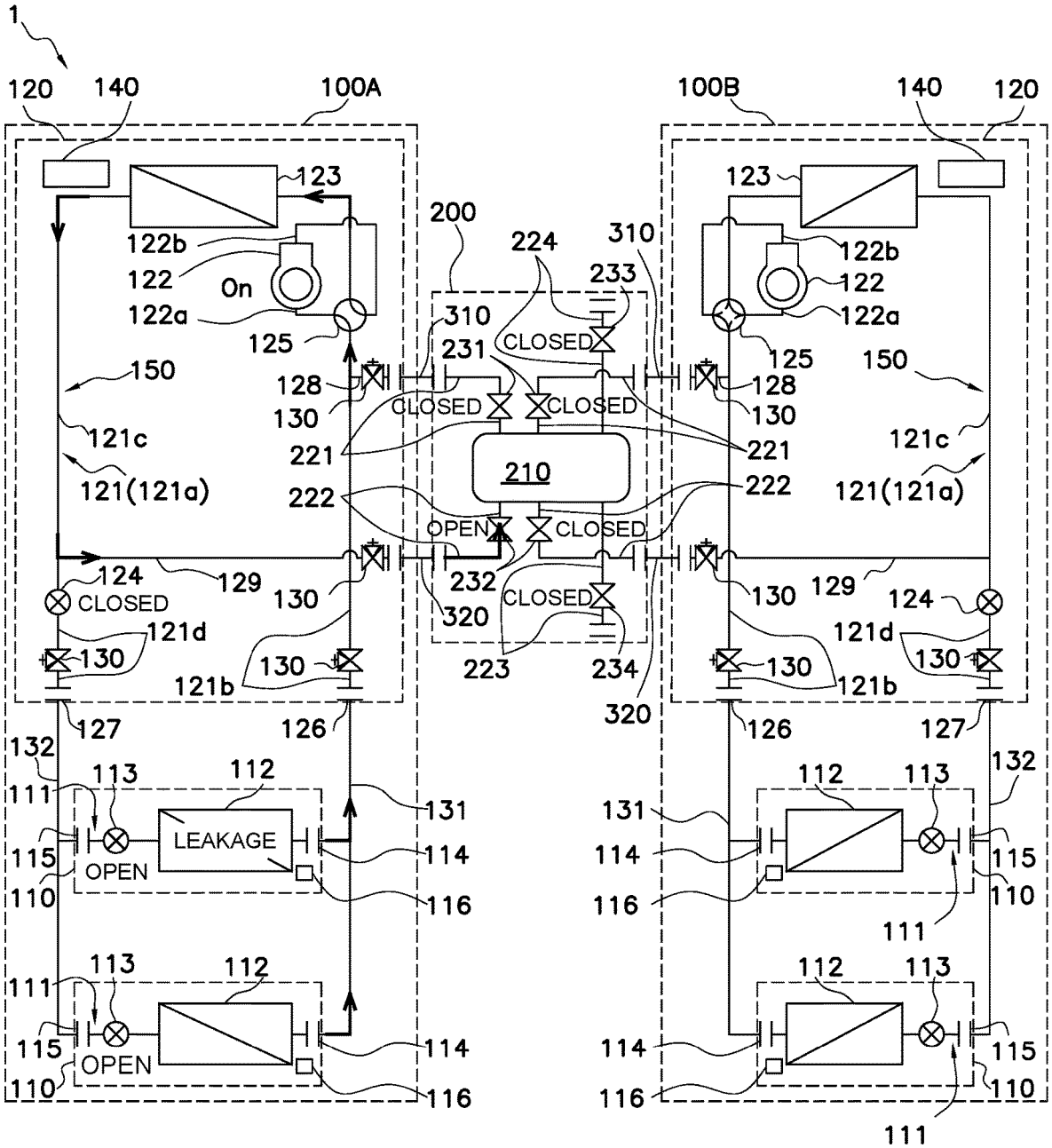
FIG. 5 is a schematic configuration diagram illustrating an operation of each device and a flow of a refrigerant during a first refrigerant storage operation.

The first refrigerant storage operation is an operation for storing mainly a liquid refrigerant in the refrigerant present inside the refrigerant circulation path 150. FIG. 5 is a schematic configuration diagram illustrating an operation of each device and a flow of a refrigerant during the first refrigerant storage operation.

In the first refrigerant storage operation, the first control unit 140 sets the indoor expansion mechanism 113A to an open state, for all the indoor units 110A. Further, for an outdoor unit 120A, the first control unit 140 sets an outdoor expansion mechanism 124A of the refrigeration cycle apparatus 100A into a closed state, sets a flow path switching mechanism 125A into the first state, and operates the first compressor 122 (On). In addition, for the refrigerant storage portion 200, the first control unit 140 sets a second storage portion on-off valve 232A to an open state, and sets the storage portion on-off valves 230 other than the second storage portion on-off valve 232A to a closed state. Specifically, the first control unit 140 sets, to the closed state, a first storage portion on-off valve 231A, a first storage portion on-off valve 231B, a second storage portion on-off valve 232B, the third storage portion on-off valve 233, and the fourth storage portion on-off valve 234.

By executing the first refrigerant storage operation, the refrigerant in the indoor refrigerant flow path 111A is suctioned into the first compressor 122A of the outdoor unit 120A, as indicated by an arrow in FIG. 5. The refrigerant suctioned into the first compressor 122A is discharged from the first compressor 122A, and then passes through the flow path switching mechanism 125A and an outdoor heat exchanger 123A. The refrigerant having passed through the outdoor heat exchanger 123A is sent to the outdoor expansion mechanism 124A, but flows into the liquid-side branch pipe 129A since the outdoor expansion mechanism 124A is in the closed state. The refrigerant having flowed into the liquid-side branch pipe 129A passes through the second storage portion pipe 222A, and flows into the storage container 210. Since the storage portion on-off valves 230 other than the second storage portion on-off valve 232A of the refrigerant storage portion 200 are in the closed state, the refrigerant having flowed is stored in the storage container 210.

After executing the first refrigerant storage operation for a predetermined time T1 set in advance, the first control unit 140 ends the first refrigerant storage operation, and starts the second refrigerant storage operation. The predetermined time T1 is set to a length that allows the liquid refrigerant present inside the refrigerant circulation path 150A to be stored into the storage container 210, for example.

(Second Refrigerant Storage Operation)

Figure 6:
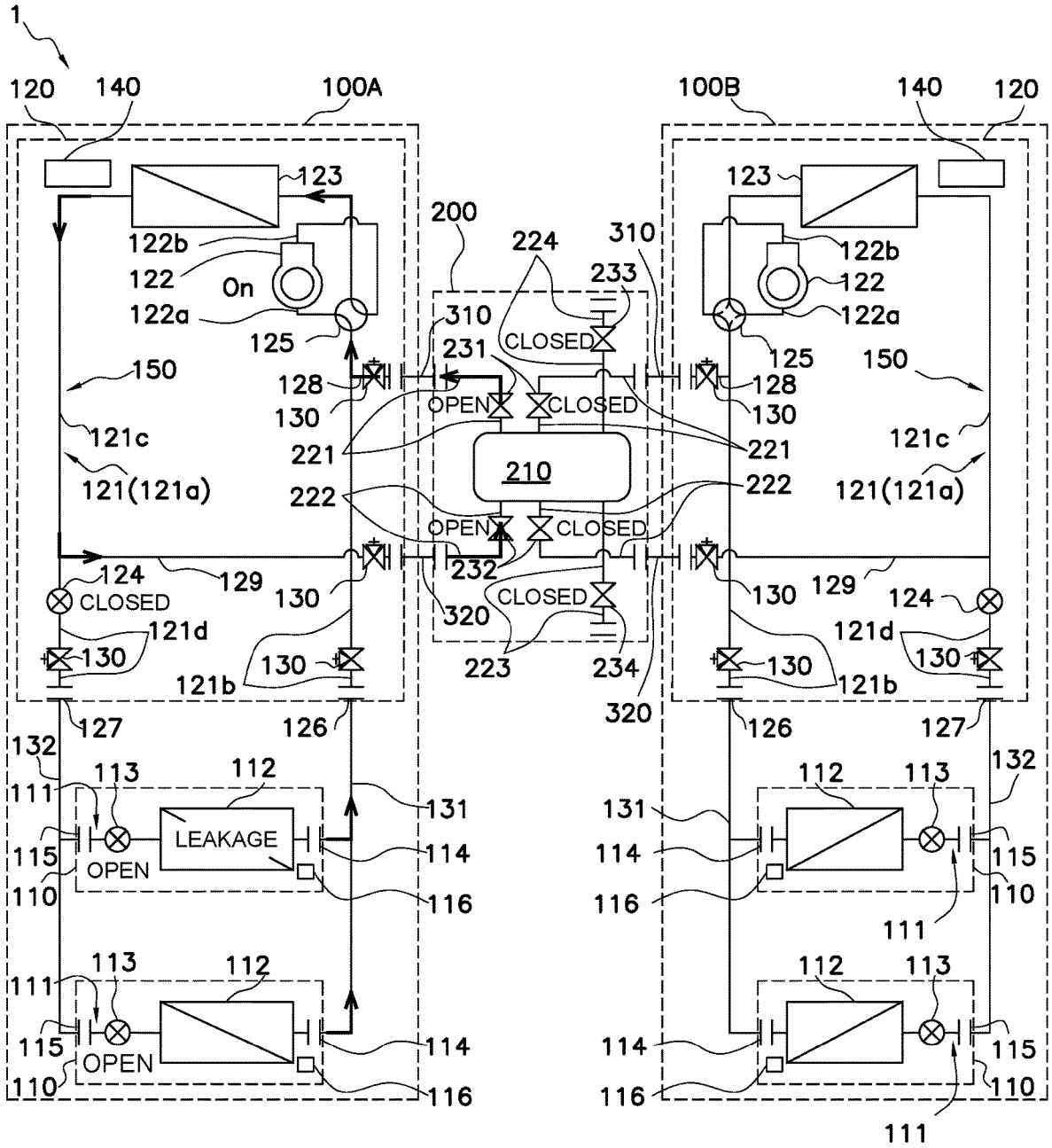
FIG. 6 is a schematic configuration diagram illustrating an operation of each device and a flow of a refrigerant during a second refrigerant storage operation.

The second refrigerant storage operation is an operation for storing, into the storage container 210, mainly a gas refrigerant remaining in the outdoor refrigerant flow path 121 without being stored in the storage container 210 even after the execution of the first refrigerant storage operation. FIG. 6 is a schematic configuration diagram illustrating an operation of each device and a flow of a refrigerant during the second refrigerant storage operation.

In the second refrigerant storage operation, the first control unit 140A sets the first storage portion on-off valve 231A to an open state, for the refrigerant storage portion 200. The state of the first refrigerant storage operation is maintained for other devices.

By executing the second refrigerant storage operation, the gas refrigerant in the refrigerant stored in the storage container 210 flows into a first storage portion pipe 221A through the first storage portion on-off valve 231A, as indicated by an arrow in FIG. 6. The refrigerant having flowed into the first storage portion pipe 221A is sent to the outdoor refrigerant flow path 121A, passes through the flow path switching mechanism 125A, and is suctioned by the first compressor 122A. The refrigerant suctioned into the first compressor 122A is discharged from the first compressor 122A, and passes through the outdoor heat exchanger 123A. The refrigerant having passed through the outdoor heat exchanger 123A is sent to the outdoor expansion mechanism 124A, but flows into the liquid-side branch pipe 129A since the outdoor expansion mechanism 124A is in the closed state. The refrigerant having flowed into the liquid-side branch pipe 129A passes through the second storage portion pipe 222A, and returns to the storage container 210.

After executing the second refrigerant storage operation for a predetermined time T2 set in advance, the first control unit 140 ends the second refrigerant storage operation. The predetermined time T2 is set to, for example, a length that allows the refrigerant remaining in the refrigerant circulation path 150A after the execution of the first refrigerant storage operation to be recovered into the storage container 210.

As described above, even when the refrigerant leaks from the refrigerant circulation path 150A, since the refrigerant present inside the refrigerant circulation path 150A is stored in the storage container 210 by executing the refrigerant storage operation by the first control unit 140, further leakage of the refrigerant is prevented.

(3-1-2) Refrigerant Filling Operation

Figure 7:
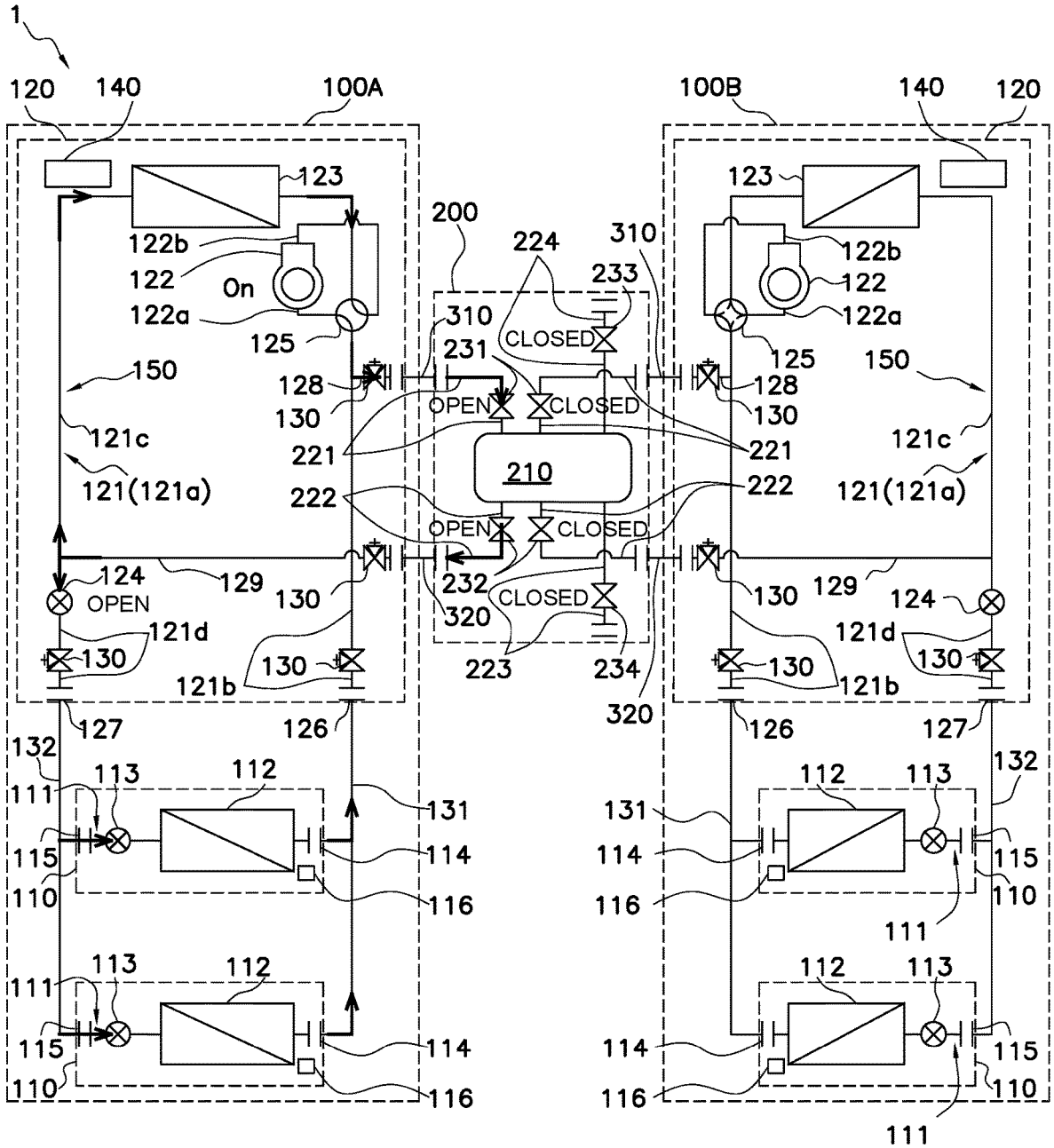
FIG. 7 is a schematic configuration diagram illustrating an operation of each device and a flow of a refrigerant during a refrigerant filling operation.

The refrigerant filling operation is an operation for filling the refrigerant circulation path 150 with the refrigerant stored in the refrigerant storage portion 200. The refrigerant filling operation is executed, for example, when the refrigeration cycle apparatus 100 in which leakage of a refrigerant is repaired is filled with the refrigerant. In the following description, a case where the refrigeration cycle apparatus 100A is filled with the refrigerant will be described as an example. FIG. 7 is a schematic configuration diagram illustrating an operation of each device and a flow of a refrigerant during the refrigerant filling operation. The refrigerant filling operation is an example of third control.

In the refrigerant filling operation, for the outdoor unit 120A, the first control unit 140 sets the outdoor expansion mechanism 124A of the refrigeration cycle apparatus 100A to an open state, sets the flow path switching mechanism 125A to the second state, and operates the first compressor 122A (On). Further, for the refrigerant storage portion 200, the first control unit 140 sets the first storage portion on-off valve 231A and the second storage portion on-off valve 232A to an open state, and sets the first storage portion on-off valve 231B, the second storage portion on-off valve 232B, the third storage portion on-off valve 233, and the fourth storage portion on-off valve 234 to a closed state.

By executing the refrigerant filling operation, as indicated by an arrow in FIG. 7, a discharge pressure of the first compressor 122A of the outdoor unit 120A acts inside the storage container 210, via the flow path switching mechanism 125, the gas-side branch pipe 128A, and the first storage portion pipe 221A. Due to the discharge pressure acting inside the storage container 210, the refrigerant present inside the storage container 210 flows into the second storage portion pipe 222A, and is made to fill the refrigerant circulation path 150 via the liquid-side branch pipe 129.

After executing the refrigerant filling operation for a predetermined time T3 set in advance, the first control unit 140 ends the refrigerant filling operation. The predetermined time T3 is set to, for example, a length that allows the refrigerant circulation path 150 to be filled with the refrigerant stored in the storage container 210.

(3-2) Operation of Refrigerant Recovery Apparatus

The refrigerant recovery operation executed by the second control unit 580 of the refrigerant recovery apparatus 5 will be described.

(3-2-1) Refrigerant Recovery Operation

Figure 8:
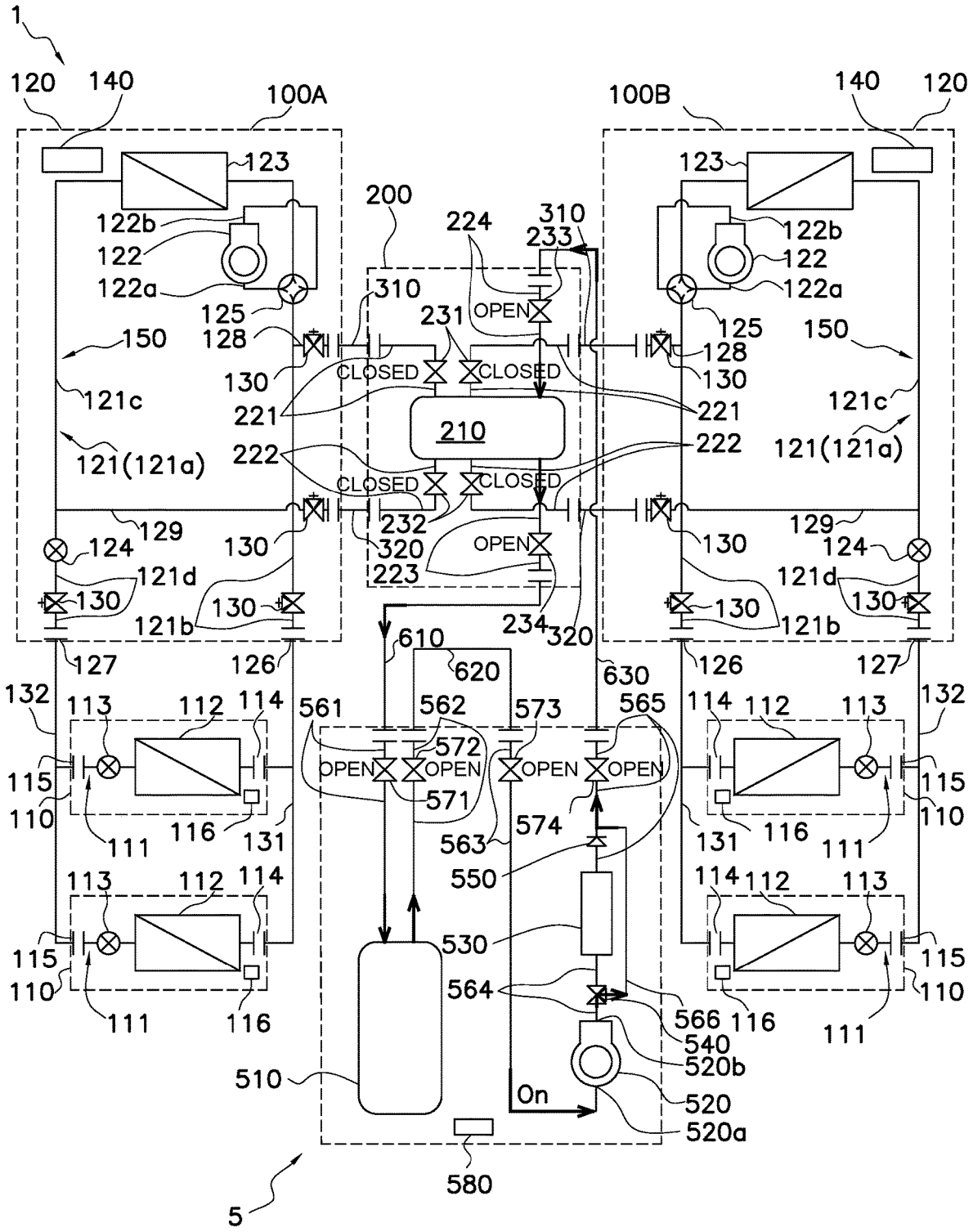
FIG. 8 is a schematic configuration diagram illustrating an operation of each device and a flow of a refrigerant during a first refrigerant recovery operation.
Figure 9:
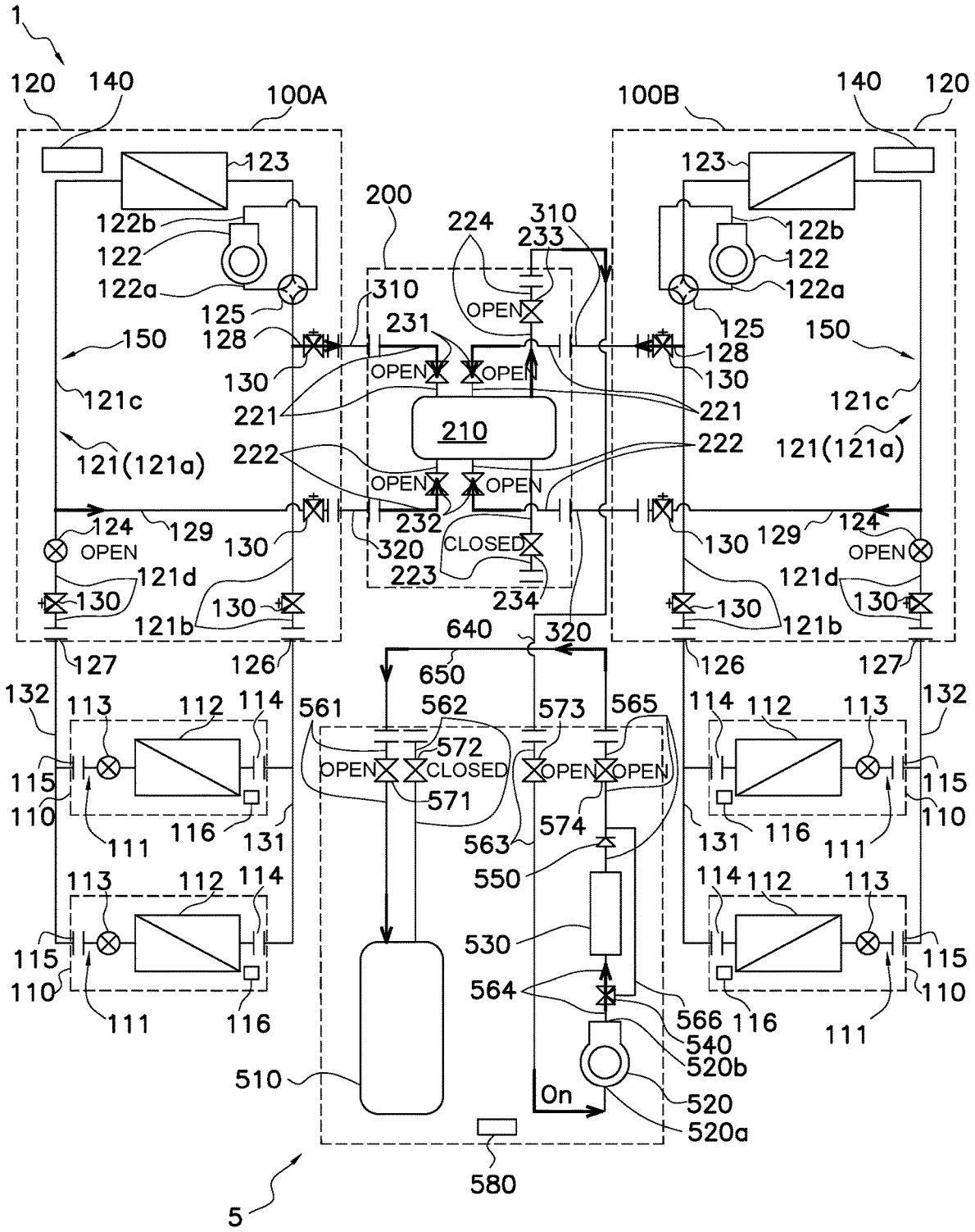
FIG. 9 is a schematic configuration diagram illustrating an operation of each device and a flow of a refrigerant during a second refrigerant recovery operation.

The refrigerant recovery operation is executed to recover the refrigerant in the refrigeration cycle system 1. The refrigerant recovery operation is executed to recover the refrigerant when the refrigeration cycle system 1 is repaired, moved, or removed, for example. The refrigerant recovery operation includes a first refrigerant recovery operation and a second refrigerant recovery operation executed after an end of the first refrigerant recovery operation. FIG. 8 is a schematic configuration diagram illustrating an operation of each device and a flow of a refrigerant during the first refrigerant recovery operation. FIG. 9 is a schematic configuration diagram illustrating an operation of each device and a flow of a refrigerant during the second refrigerant recovery operation. The first refrigerant recovery operation is an example of fourth control. The second refrigerant recovery operation is an example of fifth control.

(First Refrigerant Recovery Operation)

The first refrigerant recovery operation is an operation for mainly recovering a liquid refrigerant present inside the storage container 210.

In executing the first refrigerant recovery operation, the refrigeration cycle system 1 and the refrigerant recovery apparatus 5 are connected by the refrigerant recovery connecting pipe 600 as illustrated in FIG. 8. Specifically, the first recovery apparatus pipe 561 is connected to the third storage portion pipe 223 by a first refrigerant recovery connecting pipe 610. The second recovery apparatus pipe 562 is connected to the third recovery apparatus pipe 563 by a second refrigerant recovery connecting pipe 620. The fourth recovery apparatus pipe 564 is connected to the fourth storage portion pipe 224 by a third refrigerant recovery connecting pipe 630. The refrigeration cycle system 1 and the refrigerant recovery apparatus 5 are connected by the refrigerant recovery connecting pipe 600 by a person (for example, a worker).

In the first refrigerant recovery operation, for the refrigerant recovery apparatus 5, the second control unit 580 operates the second compressor 520 (On), sets the switching valve 540 to the second state, and sets all the recovery apparatus on-off valves 570 to an open state. Further, in cooperation with the first control unit 140, for the refrigerant storage portion 200, the second control unit 580 sets the first storage portion on-off valve 231 and the second storage portion on-off valve 232 to a closed state, and sets the third storage portion on-off valve 233 and the fourth storage portion on-off valve 234 to an open state.

By executing the first refrigerant recovery operation, as indicated by an arrow in FIG. 8, a discharge pressure of the second compressor 520 of the refrigerant recovery apparatus 5 acts on the storage container 210, via the sixth recovery apparatus pipe 566, the fifth recovery apparatus pipe 565, the third refrigerant recovery connecting pipe 630, and the third storage portion pipe 223. Due to the discharge pressure acting on the storage container 210, the refrigerant present inside the storage container 210 is recovered into the recovery container 510 via the fourth storage portion pipe 224, the first refrigerant recovery connecting pipe 610, and the first recovery apparatus pipe 561.

After executing the first refrigerant recovery operation for a predetermined time T4 set in advance, the second control unit 580 ends the first refrigerant recovery operation, and starts the second refrigerant recovery operation. The predetermined time T4 is set to, for example, a length that allows the liquid refrigerant present inside the storage container 210 to be recovered into the recovery container 510.

(Second Refrigerant Recovery Operation)

The second refrigerant recovery operation is an operation for recovering, into the recovery container 510, mainly a gas refrigerant remaining in the storage container 210 without being recovered even after execution of the first refrigerant recovery operation, and a liquid and gas refrigerant present in the refrigerant circulation path 150.

In executing the second refrigerant recovery operation, the refrigeration cycle system 1 and the refrigerant recovery apparatus 5 are connected by the refrigerant recovery connecting pipe 600 as illustrated in FIG. 9. Specifically, the first recovery apparatus pipe 561 is connected to the fourth recovery apparatus pipe 564 by a fifth refrigerant recovery connecting pipe 650. The third recovery apparatus pipe 563 is connected to the fourth storage portion pipe 224 by a fourth refrigerant recovery connecting pipe 640. The refrigeration cycle system 1 and the refrigerant recovery apparatus 5 are connected by the refrigerant recovery connecting pipe 600 by a person (for example, a worker).

In the second refrigerant recovery operation, for the refrigerant recovery apparatus 5, the second control unit 580 operates the second compressor 520, and sets the switching valve 540 to the first state. Further, the second control unit 580 sets the outdoor expansion mechanism 124 to an open state for all the refrigeration cycle apparatuses 100. In addition, the second control unit 580 sets the recovery apparatus on-off valves 570 except for the second recovery apparatus on-off valve 572 to an open state, for the refrigerant recovery apparatus 5. Moreover, in cooperation with the first control unit 140, the second control unit 580 sets the fourth storage portion on-off valve 234 to a closed state, and sets the storage portion on-off valves 230 other than the fourth storage portion on-off valve 234 to an open state, for the refrigerant storage portion 200.

By executing the second refrigerant recovery operation, as indicated by an arrow in FIG. 9, a suction pressure of the second compressor 520 of the refrigerant recovery apparatus 5 acts on the storage container 210, via the third recovery apparatus pipe 563, the fourth refrigerant recovery connecting pipe 640, and the third storage portion pipe 223. The suction pressure acting on the storage container 210 further acts on the refrigerant circulation path 150, via the first storage portion pipe 221 and the gas-side branch pipe 128, the second storage portion pipe 222 and the liquid-side branch pipe 129. The action of the suction pressure causes the refrigerant present inside the refrigerant circulation path 150 to flow into the storage container 210, via the first storage portion pipe 221 and the gas-side branch pipe 128, the second storage portion pipe 222 and the liquid-side branch pipe 129. The refrigerant having flowed into the storage container 210 flows into the refrigerant recovery apparatus 5 via the fourth refrigerant recovery connecting pipe 640. The refrigerant having flowed into the refrigerant recovery apparatus 5 is suctioned into the second compressor 520 via the third recovery apparatus pipe 563. The refrigerant discharged from the second compressor 520 passes through the fourth refrigerant recovery connecting pipe 640, the heat exchanger 530, the fifth refrigerant recovery connecting pipe 650, the check valve 550, the fifth refrigerant recovery connecting pipe 650, and the first recovery apparatus pipe 561, and is recovered into the recovery container 510. When passing through the heat exchanger 530, the refrigerant discharged from the second compressor 520 exchanges heat with air in an installation location of the refrigerant recovery apparatus 5 to be condensed, so that mainly the liquid refrigerant is recovered into the recovery container 510.

After executing the second refrigerant recovery operation for a predetermined time T5 set in advance, the second control unit 580 ends the second refrigerant recovery operation. The predetermined time T5 is set to, for example, a length that allows the refrigerant present inside the refrigerant circulation path 150 of the refrigeration cycle system 1 to be recovered into the recovery container 510.

(4) Features 4-1

The refrigeration cycle system 1 includes the refrigeration cycle apparatus 100 and the refrigerant storage portion 200. The refrigeration cycle apparatus 100 includes the indoor unit 110 having the indoor refrigerant flow path 111, the outdoor unit 120 having the outdoor refrigerant flow path 121, and the gas-side connection pipe 131 and the liquid-side connection pipe 132 that connect the indoor refrigerant flow path 111 and the outdoor refrigerant flow path 121. The refrigerant storage portion 200 stores a refrigerant present inside the refrigerant circulation path 150 formed by the indoor refrigerant flow path 111, the outdoor refrigerant flow path 121, the gas-side connection pipe 131, and the liquid-side connection pipe 132.

The outdoor refrigerant flow path 121 has: the first compressor 122; the outdoor heat exchanger 123; the outdoor expansion mechanism 124; the gas-side connecting portion 126 to which the gas-side connection pipe 131 is connected; the liquid-side connecting portion 127 to which the liquid-side connection pipe 132 is connected; the first refrigerant pipe 121*b* that connects the outdoor expansion mechanism 124 and the gas-side connecting portion 126; the second refrigerant pipe 121*c* that connects the outdoor heat exchanger 123 and the outdoor expansion mechanism 124; and the third refrigerant pipe 121*d* that connects the outdoor expansion mechanism 124 and the liquid-side connecting portion 127. The refrigerant storage portion 200 communicates with the refrigerant circulation path 150 by using the first storage portion pipe 221 and the second storage portion pipe 222.

The first storage portion pipe 221 causes the first refrigerant pipe 121*b* and the refrigerant storage portion 200 to communicate with each other, or causes the gas-side connection pipe 131 and the refrigerant storage portion 200 to communicate with each other. The second storage portion pipe 222 causes the second refrigerant pipe 121*c* and the refrigerant storage portion 200 to communicate with each other.

The refrigeration cycle apparatus according to the related art has recovered the refrigerant present in the indoor unit into the outdoor unit, when leakage of the refrigerant is detected in the indoor unit. However, an amount of refrigerant that can be stored in a refrigerant flow path of the outdoor unit is limited. Particularly, in recent years, an outdoor unit or an outdoor heat exchanger used in the outdoor unit has been made compact due to development of technology, and an amount of refrigerant that can be stored in the outdoor unit has been reduced.

The refrigeration cycle system 1 according to the embodiment of the present disclosure can store a refrigerant present inside the refrigerant circulation path 150 into the refrigerant storage portion 200 provided separately from the refrigeration cycle apparatus 100, by using the first storage portion pipe 221 and the second storage portion pipe 222. Therefore, the refrigeration cycle system 1 can store a larger amount of refrigerant into the refrigerant storage portion 200 than a case storing the refrigerant into the outdoor refrigerant flow path 121.

4-2

The refrigeration cycle system 1 includes a plurality of refrigeration cycle apparatuses 100.

The refrigeration cycle system 1 can store the refrigerant present inside the refrigerant circulation path 150 into the refrigerant storage portion 200 provided separately from the refrigeration cycle apparatus 100. Therefore, by including the plurality of refrigeration cycle apparatuses 100, the refrigeration cycle system 1 can store the refrigerant into the refrigerant storage portion 200 even when the refrigerant circulation path 150 is filled with a large amount of refrigerant.

4-3

The refrigeration cycle apparatus 100 has a plurality of indoor units 110.

In a case of a refrigeration cycle apparatus provided with a plurality of indoor units for one outdoor unit as in a multi-type for a building, as compared with a refrigeration cycle apparatus provided with one indoor unit for one outdoor unit, a connection pipe for connection of the outdoor unit and the plurality of indoor units becomes long, and a volume of a refrigerant circulation path in the entire indoor unit also increases, which also increases an amount of refrigerant made to fill.

The refrigeration cycle system 1 can store the refrigerant present inside the refrigerant circulation path 150 into the refrigerant storage portion 200 provided separately from the refrigeration cycle apparatus 100. Accordingly, by having the plurality of indoor units 110, the refrigeration cycle system 1 can store the refrigerant into the refrigerant storage portion 200 even when the refrigerant circulation path 150 is filled with a large amount of refrigerant.

4-4

The refrigeration cycle system 1 further includes the first storage portion on-off valve 231 and the second storage portion on-off valve 232. The first storage portion on-off valve 231 allows or interrupts a flow of a refrigerant between the first refrigerant pipe 121*b* and the refrigerant storage portion 200 or between the gas-side connection pipe 131 and the refrigerant storage portion 200. The second storage portion on-off valve 232 allows or interrupts a flow of a refrigerant between the second refrigerant pipe 121*c* and the refrigerant storage portion 200.

4-5

The refrigeration cycle system 1 further includes the first control unit 140. The first control unit 140 controls the first compressor 122, the outdoor expansion mechanism 124, and the flow path switching mechanism 125. The flow path switching mechanism 125 takes the first state of causing the outdoor heat exchanger 123 to function as a condenser, or the second state of causing the outdoor heat exchanger 123 to function as an evaporator. The first control unit 140 executes the refrigerant storage operation including the first refrigerant storage operation and the second refrigerant storage operation. When the first refrigerant storage operation ends, the first control unit 140 executes the second refrigerant storage operation. In the first refrigerant storage operation, the first control unit 140 sets the flow path switching mechanism 125 to the first state, sets the outdoor expansion mechanism 124 to a closed state, and operates the first compressor 122 to store the refrigerant into the refrigerant storage portion 200. In the second refrigerant storage operation, the first control unit 140 operates the first compressor 122, sets the first storage portion on-off valve 231 to an open state, and stores the gas refrigerant into the refrigerant storage portion 200.

This feature enables the refrigeration cycle system 1 to automatically store the refrigerant into the refrigerant storage portion 200 by causing the first control unit 140 to execute the refrigerant storage operation.

4-6

The first control unit 140 executes the refrigerant filling operation. In the refrigerant filling operation, the first control unit 140 sets the flow path switching mechanism 125 to the second state, sets the outdoor expansion mechanism 124 to an open state, and operates the first compressor 122 to fill the refrigerant circulation path 150 with the refrigerant present inside the refrigerant storage portion 200.

This feature enables the refrigeration cycle system 1 to fill the refrigerant circulation path 150 of the refrigeration cycle apparatus 100 with the refrigerant stored in the refrigerant storage portion 200.

4-7

The outdoor refrigerant flow path 121 further has the liquid-side branch pipe 129. The liquid-side branch pipe 129 is connected to the first refrigerant pipe 121*b*. The second storage portion pipe 222 communicates with the liquid-side branch pipe 129.

4-8

The outdoor refrigerant flow path 121 further has the gas-side branch pipe 128. The gas-side branch pipe 128 is connected to the second refrigerant pipe 121*c*. The first storage portion pipe 221 communicates with the gas-side branch pipe 128.

4-9

The outdoor unit 120 has four outdoor refrigerant flow path shutoff valves 130. The outdoor refrigerant flow path shutoff valve 130 allows or interrupts communication of the outdoor refrigerant flow path 121. The outdoor refrigerant flow path shutoff valve 130 is provided in the first refrigerant pipe 121*b*, the third refrigerant pipe 121*d*, the gas-side branch pipe 128, and the liquid-side branch pipe 129.

By closing the outdoor refrigerant flow path shutoff valve 130, leakage of the refrigerant sealed in the outdoor unit 120 to an outside can be prevented at a time of installation or the like of the refrigeration cycle apparatus 100.

4-10

The indoor refrigerant flow path 111 has the indoor heat exchanger 112. The indoor unit 110 has the detection unit 116 that detects leakage of the refrigerant. The first control unit 140 executes the first refrigerant storage operation after the detection unit 160 detects leakage of the refrigerant.

This feature allows the refrigeration cycle system 1 to cause the first control unit 140 to execute the refrigerant storage operation in response to detection of leakage of the refrigerant in the indoor unit 110. As a result, even if the refrigerant leaks in the indoor unit 110, the refrigerant can be automatically stored in the refrigerant storage portion 200, which can prevent release of the refrigerant into the atmosphere.

4-11

The refrigerant has flammability or toxicity.

The refrigeration cycle system 1 can automatically store the refrigerant into the refrigerant storage portion 200 even if the refrigerant having flammability or toxicity leaks, which can prevent contamination of the air conditioning target space due to leakage of the refrigerant.

4-12

The refrigerant recovery apparatus 5 recovers the refrigerant in the refrigeration cycle system 1 described above. The refrigerant recovery apparatus 5 includes the recovery container 510, the second compressor 520, and the second control unit 580. The recovery container 510 contains the refrigerant. The second compressor 520 applies a predetermined pressure to an inside of the refrigerant storage portion 200 of the refrigeration cycle system 1. The second control unit 580 controls the second compressor 520. The second control unit 580 controls the second compressor 520 to recover the refrigerant present in the refrigerant circulation path 150 of the refrigeration cycle system 1 into the recovery container 510.

This feature enables the refrigerant recovery apparatus 5 to recover the refrigerant stored in the refrigerant storage portion 200 into the recovery container 510. In particular, the refrigerant recovery apparatus 5 can recover the refrigerant from the refrigerant storage portion 200 that stores the refrigerant of the plurality of refrigeration cycle apparatuses 100. Therefore, even in the refrigeration cycle system 1 having the plurality of indoor units 110 such as the multi-type for a building, the refrigerant can be recovered in a short time as compared with a case of performing the refrigerant recovery operation for each refrigeration cycle apparatus 100.

4-13

The second control unit 580 executes the refrigerant recovery operation including the first refrigerant recovery operation and the second refrigerant recovery operation. When the first refrigerant recovery operation ends, the second control unit 580 executes the second refrigerant recovery operation. During the first refrigerant recovery operation, the second control unit 580 controls the second compressor 520 to apply a discharge pressure of the second compressor 520 to an inside of the refrigerant storage portion 200, and causes the refrigerant to flow into the recovery container 510. During the second refrigerant recovery operation, the second control unit 580 controls the second compressor 520 to apply a suction pressure of the second compressor 520 to an inside of the refrigerant storage portion 200, and causes the refrigerant to flow into the recovery container 510.

This feature enables the refrigerant recovery apparatus 5 to automatically recover the refrigerant stored in the refrigerant storage portion 200 into the recovery container 510, by causing the second control unit 580 to execute the refrigerant recovery operation.

(5) Modification (5-1) Modification 1A

Figure 10:
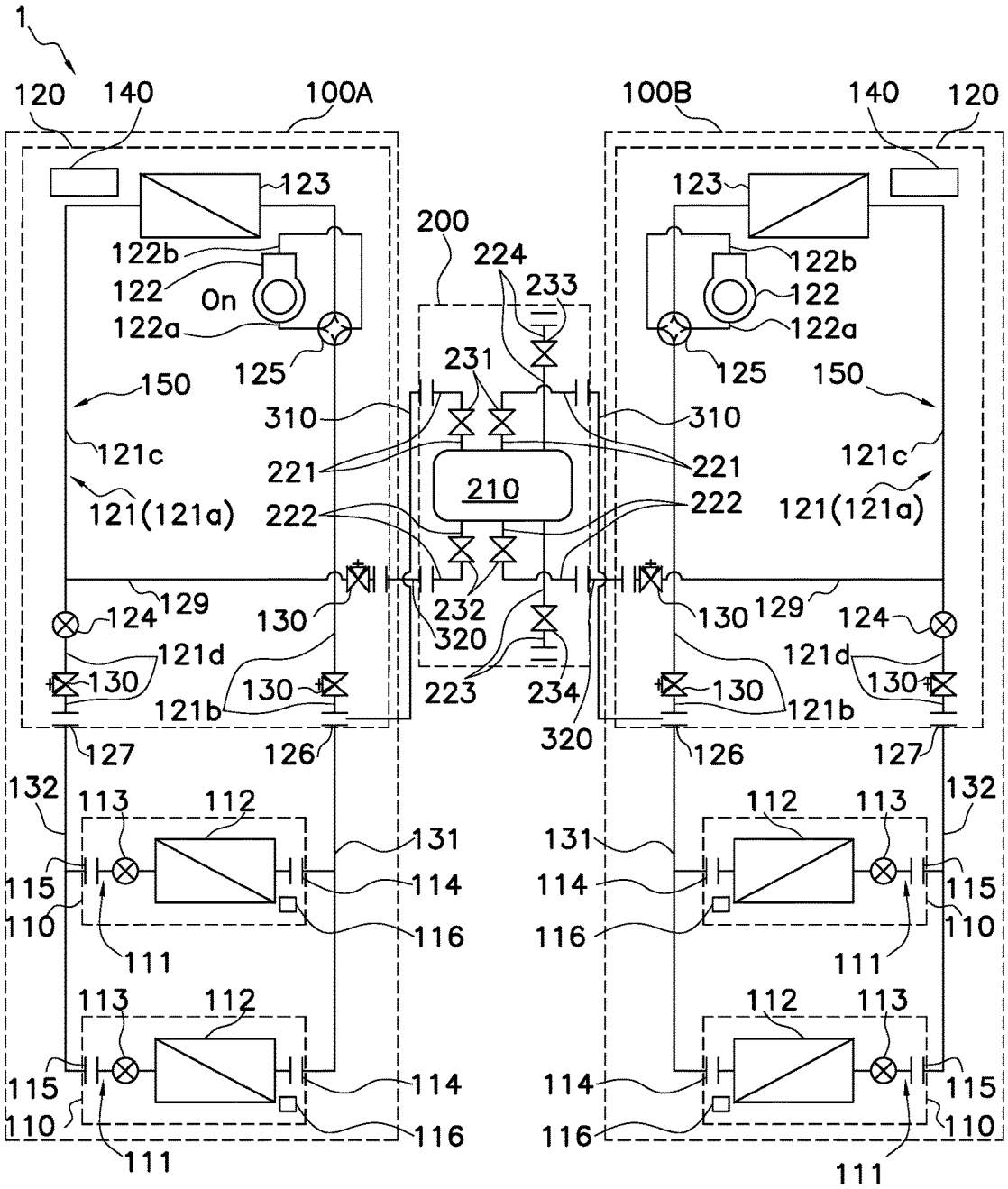
FIG. 10 is a schematic configuration diagram of a refrigeration cycle system 1 according to Modification 1A.

In the above-described embodiment, the first storage portion pipe 221 has caused the first refrigerant pipe 121*b* and the refrigerant storage portion 200 to communicate with each other via the first connecting pipe 310 and the gas-side branch pipe 128. However, communication between the refrigerant storage portion 200 and the refrigerant circulation path 150 is not limited to this mode. FIG. 10 is a schematic configuration diagram of a refrigeration cycle system 1 according to Modification 1A.

In the refrigeration cycle system 1 according to Modification 1A, the refrigeration cycle apparatus 100 does not have the gas-side branch pipe 128. In the refrigeration cycle system 1 according to Modification 1A, the first connecting pipe 310 having one end connected to the first storage portion pipe 221 has another end connected to the gas-side connecting portion 126.

In the refrigeration cycle system 1 according to Modification 1A, the gas-side branch pipe 128 and the outdoor refrigerant flow path shutoff valve 130 provided in the gas-side branch pipe 128 are unnecessary, so that an increase in manufacturing cost is prevented as compared with the above-described embodiment.

Further, although not illustrated, the first storage portion pipe 221 may be connected to the gas-side connection pipe 131.

(5-2) Modification 1B

Figure 11:
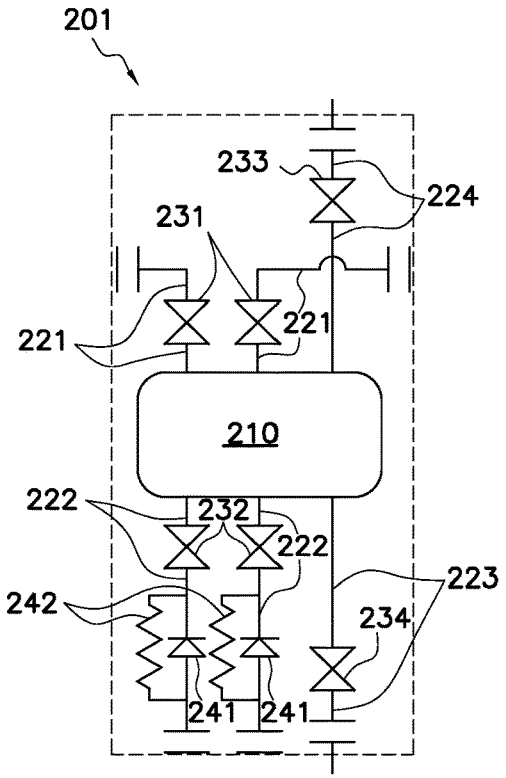
FIG. 11 is a schematic configuration diagram of a refrigerant storage portion 201 according to Modification 1B.

The refrigerant storage portion 200 is not limited to the mode described in the above-described embodiment. FIG. 11 is a schematic configuration diagram of a refrigerant storage portion 201 according to Modification 1B.

The refrigerant storage portion 201 is different from the refrigerant storage portion 200 in a second storage portion pipe 222. Specifically, the second storage portion pipe 222 has a check valve 241 and a decompressor 242 connected in parallel to each other.

The check valve 241 allows a flow of a refrigerant from an end portion of the second storage portion pipe 222 to which the liquid-side branch pipe 129 is connected toward the second storage portion on-off valve 232, and restricts a flow of the refrigerant from the second storage portion on-off valve 232 toward the end portion to which the liquid-side branch pipe 129 is connected.

The check valve 241 and the decompressor 242 are provided to prevent a situation that the refrigerant made to fill the refrigerant circulation path 150 from the refrigerant storage portion 201 via the second storage portion pipe 222 and the liquid-side branch pipe 129 in the refrigerant filling operation cannot sufficiently evaporate in the outdoor heat exchanger 123 by flowing into the outdoor heat exchanger 123 without being decompressed by the outdoor expansion mechanism 124.

According to the refrigerant storage portion 201, in the refrigerant filling operation, the refrigerant flowing from the refrigerant storage portion 201 into the second storage portion pipe 222 and caused to fill the refrigerant circulation path 150 is decompressed to a predetermined pressure by the decompressor 242. Therefore, the refrigerant made to fill the refrigerant circulation path 150 in the refrigerant filling operation can sufficiently evaporate in the outdoor heat exchanger 123, even if the refrigerant flows into the outdoor heat exchanger 123 without being decompressed by the outdoor expansion mechanism 124.

Further, since the refrigerant storage portion 201 includes the check valve 241 provided in parallel with the decompressor 242, the refrigerant from the liquid-side branch pipe 129 can made flow into the storage container 210 without being decompressed in the refrigerant storage operation.

(5-3) Modification 1C

Figure 12:
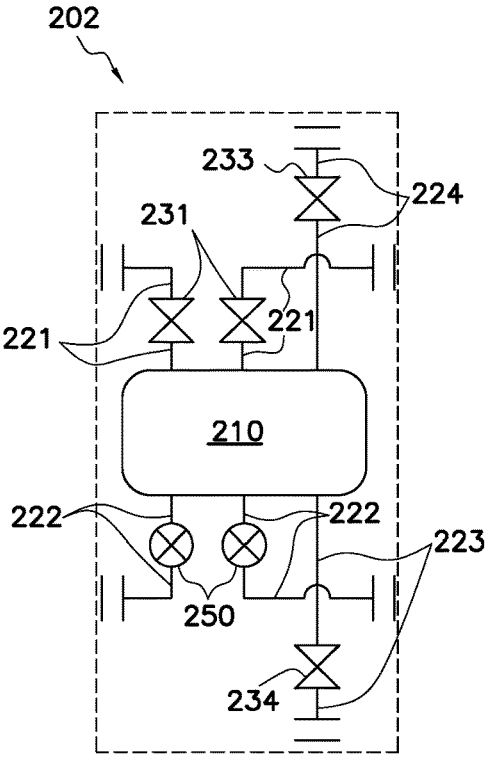
FIG. 12 is a schematic configuration diagram of a refrigerant storage portion 202 according to Modification 1C.

FIG. 12 is a schematic configuration diagram of a refrigerant storage portion 202 according to Modification 1C. The refrigerant storage portion 202 is different from the refrigerant storage portion 200 in that the second storage portion on-off valve 232 is an expansion mechanism 250.

The expansion mechanism 250 is an expansion mechanism that is fully closable and adjusts a pressure and a flow rate of the refrigerant flowing through the second storage portion pipe 222. The expansion mechanism 250 is an electronic expansion valve whose opening degree is adjusted by an actuator (not illustrated). An opening degree of the expansion mechanism 250 is controlled by the first control unit 140. Specifically, the first control unit 140 controls the opening degree of the expansion mechanism 250 to decompress the refrigerant flowing from the liquid-side branch pipe 129, during the refrigerant storage operation. Note that, in a refrigeration cycle system 1 using the refrigerant storage portion 202 according to Modification 1C, when the refrigerant storage operation and the refrigerant filling operation are performed, the expansion mechanism 250 is opened and closed by the first control unit 140.

According to the refrigerant storage portion 202, a pressure of the refrigerant flowing in from the second storage portion pipe 222 can be reduced as compared with a case where the expansion mechanism 250 is not provided. Therefore, a pressure resistance of the storage container 210 can be set low, and manufacturing cost of the storage container 210 can be suppressed low.

(5-4) Modification 1D

Figure 13:
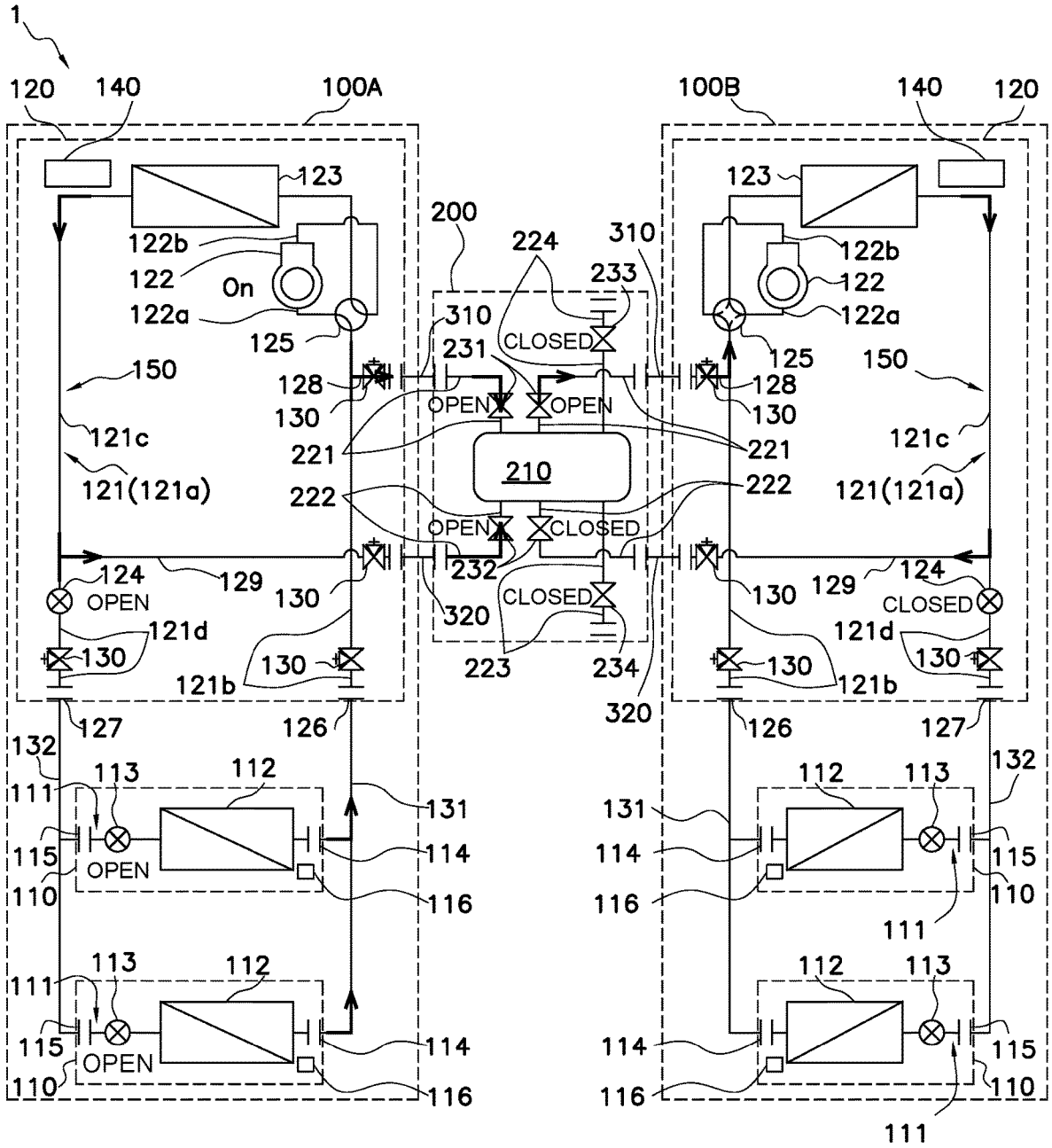
FIG. 13 is a schematic configuration diagram illustrating an operation of each device and a flow of a refrigerant during a refrigerant storage operation (Modification 1D).

The refrigerant storage operation executed by the first control unit 140 is not limited to the above-described mode. In a refrigeration cycle system 1 according to Modification 1D, the first control unit 140 executes the refrigerant storage operation by operating a first compressor 122B of the refrigeration cycle apparatus 100B without operating the first compressor 122A of the refrigeration cycle apparatus 100A. FIG. 13 is a schematic configuration diagram illustrating an operation of each device and a flow of the refrigerant during the refrigerant storage operation executed in the refrigeration cycle system 1 according to Modification 1D. The refrigerant storage operation executed by the first control unit 140 in the refrigeration cycle system 1 according to Modification 1D is executed after the refrigerant in the refrigeration cycle apparatus 100B is recovered into the recovery container 510 by the refrigerant recovery apparatus 5 through the refrigerant storage portion 200. Hereinafter, the description will be started from a state after the refrigerant of the refrigeration cycle apparatus 100B is recovered into the recovery container 510 by the refrigerant recovery apparatus 5 through the refrigerant storage portion 200.

In the refrigerant storage operation, the first control unit 140 sets the indoor expansion mechanism 113A to an open state and does not operate the first compressor 122A (Off), for all the indoor units 110. Further, for the outdoor unit 120A, the first control unit 140 sets the outdoor expansion mechanism 124A to an open state, and sets the flow path switching mechanism 125A to the first state. Further, for the refrigerant storage portion 200, the first control unit 140 sets the first storage portion on-off valve 231A, the first storage portion on-off valve 231B, the second storage portion on-off valve 232A, the third storage portion on-off valve 233, and the fourth storage portion on-off valve 234 to an open state, and sets the second storage portion on-off valve 232B to a closed state. The operation of the storage portion on-off valve 230 may be performed by a person (worker or the like).

In the refrigerant storage operation, for the outdoor unit 120B, the first control unit 140 sets an outdoor expansion mechanism 124B to a closed state, sets a flow path switching mechanism 125B to the first state, and operates the first compressor 122B (On).

By executing the refrigerant storage operation according to Modification D, a suction pressure of the first compressor 122B acts on the storage container 210 via the gas-side branch pipe 128B and a first storage portion pipe 221B. At the same time, the suction pressure of the first compressor 122B acts on the storage container 210 via the second storage portion pipe 222. As a result, as illustrated in FIG. 13, the suction pressure of the first compressor 122B via the storage container 210 acts on the indoor refrigerant flow path 111A. Therefore, the refrigerant present in the refrigerant circulation path 150 is stored in the storage container 210 via the gas-side branch pipe 128A and the first storage portion pipe 221 or the liquid-side branch pipe 129A and the second storage portion pipe 222.

As described above, in the refrigeration cycle system 1 according to Modification 1D, even when the first compressor 122A of the refrigeration cycle apparatus 100A is not operated, the refrigerant present in the refrigerant circulation path 150A can be stored in the storage container 210 by the first compressor 122B. Therefore, the refrigerant can be stored even when a failure or the like disables the operation of the first compressor 122 of any refrigeration cycle apparatus 100 among the plurality of refrigeration cycle apparatuses 100 communicating with the same refrigerant storage portion 200. Note that, the refrigerant recovery operation into the recovery container 510 performed by the refrigerant recovery apparatus 5 is the same as the operation described above, and thus a description thereof is omitted.

(5-5) Modification 1E

Figure 14:
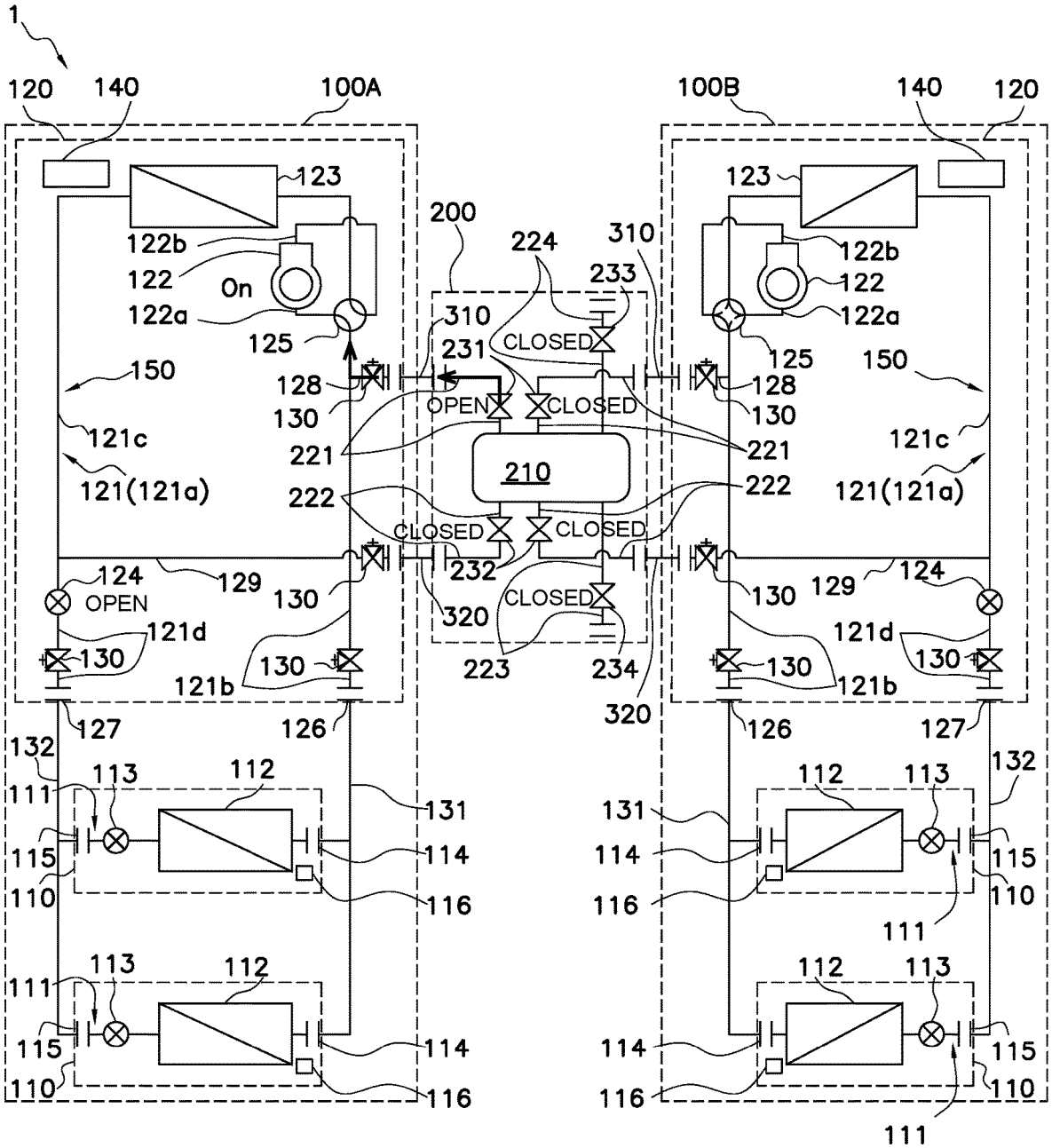
FIG. 14 is a schematic configuration diagram illustrating an operation of each device and a flow of a refrigerant during the refrigerant filling operation (Modification 1E).

The refrigerant filling operation executed by the first control unit 140 is not limited to the above-described mode. In the following description, a case where the refrigeration cycle apparatus 100A is filled with the refrigerant will be described as an example. FIG. 14 is a schematic configuration diagram illustrating an operation of each device and a flow of a refrigerant during the refrigerant filling operation executed in a refrigeration cycle system 1 according to Modification 1E.

In the refrigerant filling operation, for the outdoor unit 120A, the first control unit 140 sets the outdoor expansion mechanism 124A of the refrigeration cycle apparatus 100A to an open state, sets the flow path switching mechanism 125A to the first state, and operates the first compressor 122A (On). Further, for the refrigerant storage portion 200, the first control unit 140 sets the first storage portion on-off valve 231A to an open state, and sets the first storage portion on-off valve 231B, the second storage portion on-off valve 232A, the second storage portion on-off valve 232B, the third storage portion on-off valve 233, and the fourth storage portion on-off valve 234 to a closed state.

By executing the refrigerant filling operation, as indicated by an arrow in FIG. 14, a suction pressure of the first compressor 122A of the outdoor unit 120A acts inside the storage container 210, via the flow path switching mechanism 125, the gas-side branch pipe 128A, and the first storage portion pipe 221A. Due to the suction pressure acting inside the storage container 210, the refrigerant present inside the storage container 210 flows into the first storage portion pipe 221A and is made to fill the refrigerant circulation path 150 via the gas-side branch pipe 128.

(5-6) Modification 1F

The first control unit 140 described above has set the indoor expansion mechanism 113 to the open state for all the indoor units 110 in the refrigerant storage operation, but may set the indoor expansion mechanism 113 to a closed state only for the indoor unit 110 from which the refrigerant has leaked. For example, when refrigerant leaks rapidly due to, for example, a relatively large hole being opened in a part of the indoor heat exchanger 112, the first control unit 140 according to Modification 1F sets the indoor expansion mechanism 113 of the indoor unit 110 in which the leak has occurred to the closed state. As a result, the first control unit 140 according to Modification 1F can store the refrigerant into the refrigerant storage portion 200 while preventing leakage of a large amount of refrigerant present inside the refrigerant circulation path 150 from the indoor heat exchanger 112.

(5-7) Modification 1G

Figure 15:
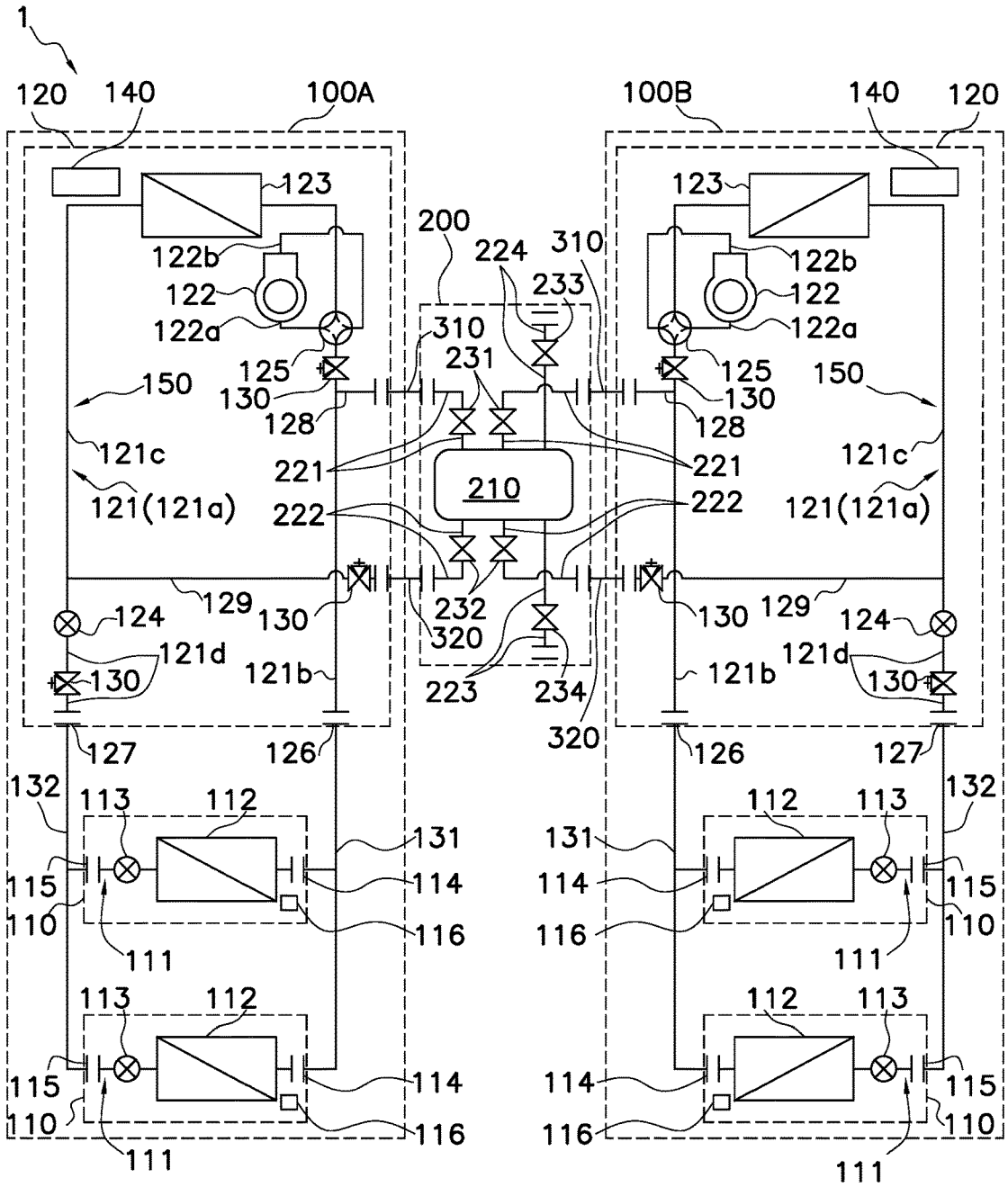
FIG. 15 is a schematic configuration diagram of a refrigeration cycle system 1 according to Modification 1G.

A position where the outdoor refrigerant flow path shutoff valve 130 is disposed is not limited to the above-described position. FIG. 15 is a schematic configuration diagram illustrating a refrigeration cycle system 1 according to Modification 1G. The refrigeration cycle apparatus 100 of the refrigeration cycle system 1 according to Modification 1G includes three outdoor refrigerant flow path shutoff valves 130. The outdoor refrigerant flow path shutoff valve 130 is provided between the flow path switching mechanism 125 of the first refrigerant pipe 121*b* and a connection point of the gas-side branch pipe 128, and provided in the third refrigerant pipe 121*d* and the liquid-side branch pipe 129. As a result, according to the refrigeration cycle apparatus 100 of the refrigeration cycle system 1 according to Modification 1G, since the number of the outdoor refrigerant flow path shutoff valves 130 can be reduced as compared with the above-described embodiment, an increase in manufacturing cost is prevented.

(5-8) Modification 1H

Figure 16:
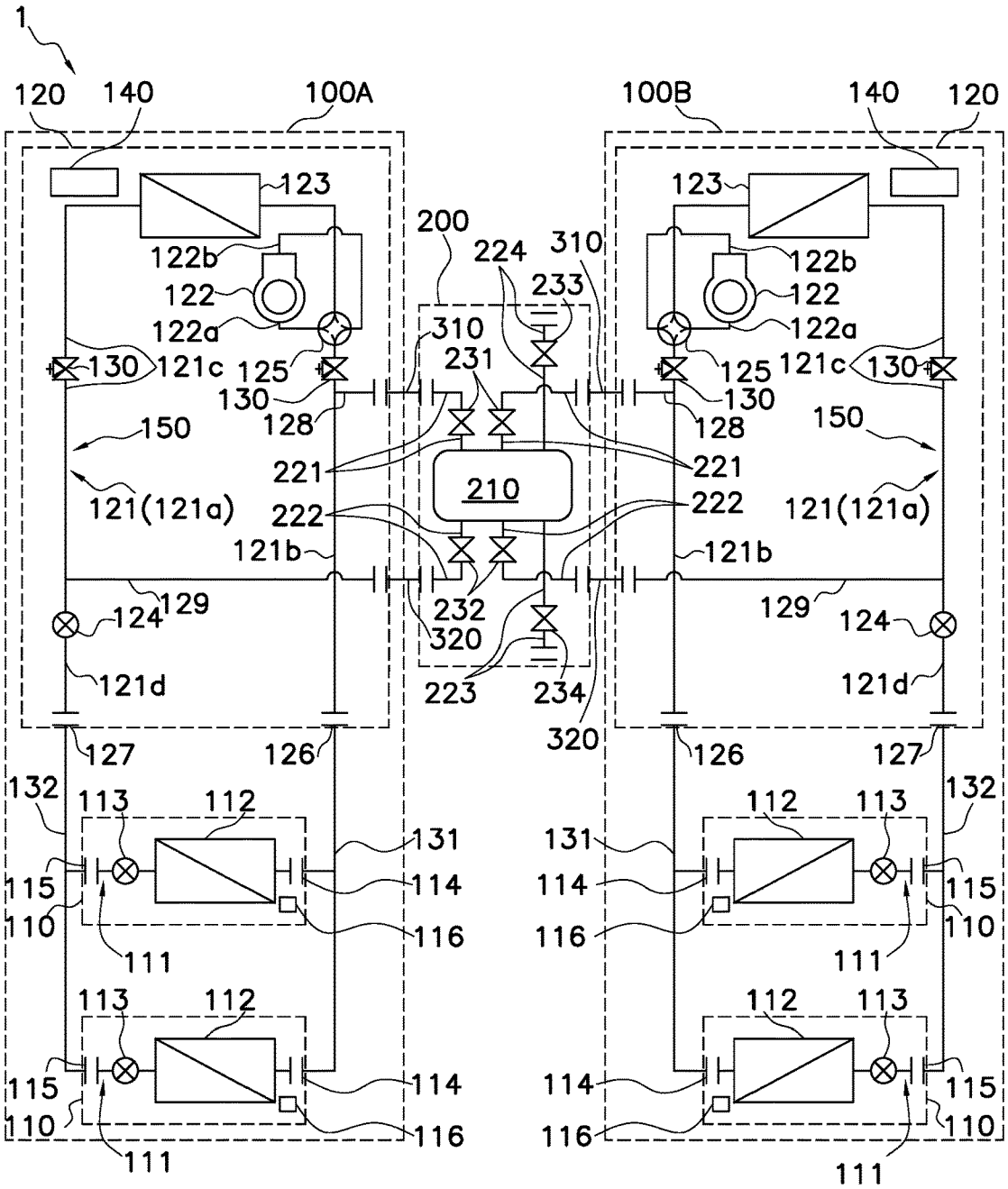
FIG. 16 is a schematic configuration diagram of a refrigeration cycle system 1 according to Modification 1H.

FIG. 16 is a schematic configuration diagram illustrating a refrigeration cycle system 1 according to Modification 1H.

The refrigeration cycle apparatus 100 of the refrigeration cycle system 1 according to Modification 1H includes two outdoor refrigerant flow path shutoff valves 130. The outdoor refrigerant flow path shutoff valve 130 is provided between the flow path switching mechanism 125 of the first refrigerant pipe 121*b* and a connection point of the gas-side branch pipe 128, and between the outdoor heat exchanger 123 of the second refrigerant pipe 121*c* and a connection point of the liquid-side branch pipe 129. As a result, according to the refrigeration cycle apparatus 100 of the refrigeration cycle system 1 according to Modification 1H, since the number of the outdoor refrigerant flow path shutoff valves 130 can be reduced as compared with the above-described embodiment and Modification 1G, an increase in manufacturing cost is prevented.

Second Embodiment

(1) Overall Configuration

Figure 17:
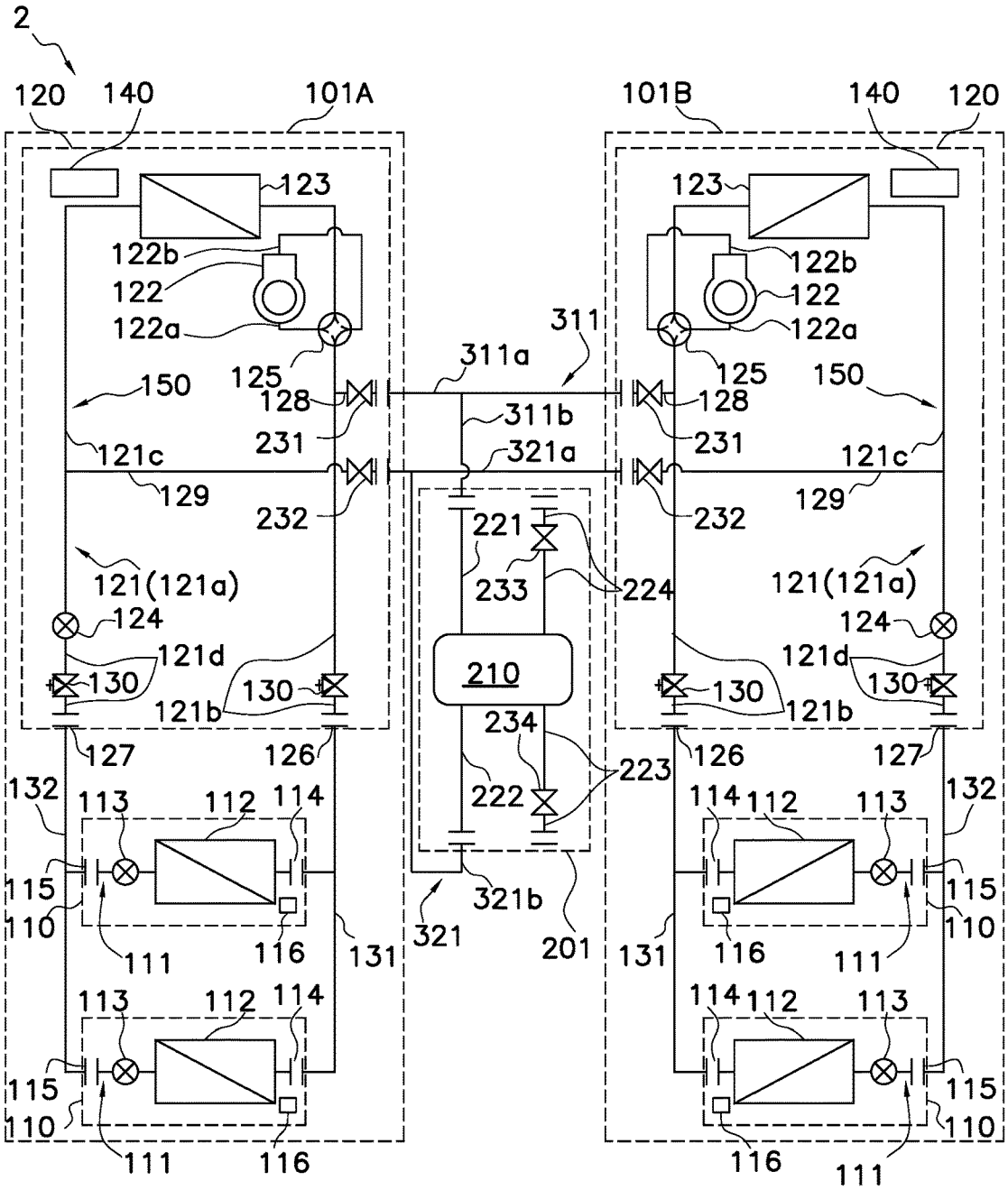
FIG. 17 is a schematic configuration diagram illustrating a refrigeration cycle system 2.

A refrigeration cycle system 2 according to a second embodiment of the present disclosure will be described focusing on differences from the refrigeration cycle system 1. FIG. 17 is a schematic configuration diagram illustrating the refrigeration cycle system 2. The refrigeration cycle system 2 includes a refrigeration cycle apparatus 101A, a refrigeration cycle apparatus 101B, one refrigerant storage portion 201, a first connecting pipe 311, and a second connecting pipe 321. Each refrigeration cycle apparatus 101 communicates with the refrigerant storage portion 201 via the first connecting pipe 311 and the second connecting pipe 321.

Although details will be described later, the refrigeration cycle system 2 is different from the refrigeration cycle system 1 in positions where a first storage portion on-off valve 231 and a second storage portion on-off valve 232 are provided, the numbers of first storage portion pipes 221, second storage portion pipes 222, and outdoor refrigerant flow path shutoff valves 130, and shapes of the first connecting pipe 311 and the second connecting pipe 321.

(2) Detailed Configuration

(2-1) Refrigeration Cycle System (2-1-1) Refrigeration Cycle Apparatus

The refrigeration cycle apparatus 101 is different from the refrigeration cycle apparatus 100 in that the refrigeration cycle apparatus 101 has the first storage portion on-off valve 231 and the second storage portion on-off valve 232, which have been included in the refrigerant storage portion 200 in the refrigeration cycle system 1. In the refrigeration cycle apparatus 101, the first storage portion on-off valve 231 is provided in a gas-side branch pipe 128 instead of the outdoor refrigerant flow path shutoff valve 130. Further, the second storage portion on-off valve 232 is provided in a liquid-side branch pipe 129 instead of the outdoor refrigerant flow path shutoff valve 130. Accordingly, an outdoor unit 120 of the refrigeration cycle apparatus 101 has two outdoor refrigerant flow path shutoff valves 130.

(2-1-2) Refrigerant Storage Portion

The refrigerant storage portion 201 is different from the refrigerant storage portion 200 in that the refrigerant storage portion 201 has one first storage portion pipe 221 and one second storage portion pipe 222, and does not have the first storage portion on-off valve 231 and the second storage portion on-off valve 232.

(2-1-3) First Connecting Pipe

The first connecting pipe 311 is different from the first connecting pipe 311 in that the first connecting pipe 311 is formed by connecting two pipes. The first connecting pipe 311 has a main pipe 311*a* and a branch pipe 311*b*. One end of the main pipe 311*a* is connected to a gas-side branch pipe 128A. Another end of the main pipe 311*a* is connected to a gas-side branch pipe 128B. One end of the branch pipe 311*b* is connected to the main pipe 311*a*. Another end of the branch pipe 311*b* is connected to the first storage portion pipe 221 of the refrigerant storage portion 201.

(2-1-4) Second Connecting Pipe

The second connecting pipe 321 is different from the second connecting pipe 321 in that the second connecting pipe 321 is formed by connecting two pipes. The second connecting pipe 321 has a main pipe 321*a* and a branch pipe 321*b*. One end of the main pipe 321*a* is connected to a liquid-side branch pipe 129A. Another end of the main pipe 321*a* is connected to a liquid-side branch pipe 129B. One end of the branch pipe 321*b* is connected to the main pipe 321*a*. Another end of the branch pipe 321*b* is connected to the second storage portion pipe 222 of the refrigerant storage portion 201.

(3) Operation

(3-1) Operation of Refrigeration Cycle Apparatus (3-1-1) Refrigerant Storage Operation and Refrigerant Filling Operation Since operations of each device in a refrigerant storage operation and a refrigerant filling operation of the refrigeration cycle system 2 are similar to those of the refrigeration cycle system 1, a description thereof will be omitted.

A flow of the refrigerant in the refrigerant storage operation and the refrigerant filling operation of the refrigeration cycle system 2 is different from that in the refrigeration cycle system 1 in a path through which the refrigerant having flowed out of the refrigeration cycle apparatus 101 or the refrigerant storage portion 201 flows. Specifically, in the first refrigerant storage operation and the second refrigerant storage operation, the refrigerant having flowed out of the liquid-side branch pipe 129 of the refrigeration cycle apparatus 101 on a side where the refrigerant storage operation is executed flows into the main pipe 321*a* of the second connecting pipe 321, and then flows into the refrigerant storage portion 201 via the branch pipe 321*b*.

Further, the refrigerant having flowed out of the refrigerant storage portion 201 in the second refrigerant storage operation flows into the branch pipe 311*b* of the first connecting pipe 311, and then flows into the refrigeration cycle apparatus 101 on the side where the refrigerant storage operation is executed, via the main pipe 311*a*.

Moreover, the refrigerant having flowed out of the refrigerant storage portion 201 in the refrigerant filling operation flows into the branch pipe 321*b* of the second connecting pipe 321, and then flows into the refrigeration cycle apparatus 101 on a side where the filling operation is executed, via the main pipe 321*a*.

(3-1-2) Refrigerant Recovery Operation

Since an operation of each device in the refrigerant recovery operation of the refrigeration cycle system 2 is similar to that of the refrigeration cycle system 1, a description thereof will be omitted.

A flow of the refrigerant in the refrigerant recovery operation of the refrigeration cycle system 2 is different from that of the refrigeration cycle system 1 in a path through which the refrigerant having flowed out of the refrigeration cycle apparatus 101 flows. Specifically, in the second refrigerant recovery operation, the refrigerant having flowed out of the gas-side branch pipe 128 of the refrigeration cycle apparatus 101 flows into the main pipe 311*a* of the first connecting pipe 311, and then flows into the refrigerant storage portion 201 via the branch pipe 311*b*.

Further, in the second refrigerant recovery operation, the refrigerant having flowed out of the liquid-side branch pipe 129 of the refrigeration cycle apparatus 101 flows into the main pipe 321*a* of the second connecting pipe 321, and then flows into the refrigerant storage portion 201 via the branch pipe 321*b*.

(4) Features 4-1

In the refrigeration cycle system 2, each refrigeration cycle apparatus 101 is provided with the first storage portion on-off valve 231 and the second storage portion on-off valve 232, and all the refrigeration cycle apparatuses 101 and the refrigerant storage portion 201 have been caused to communicate with each other via the first connecting pipe 311 and the second connecting pipe 321 by one first storage portion pipe 221*a* and one second storage portion pipe 222*a*.

This feature eliminates necessity of providing the first storage portion pipe 221 and the second storage portion pipe 222 for each of all the refrigeration cycle apparatuses 100, unlike the refrigeration cycle system 1. Therefore, in the refrigeration cycle system 2, the refrigeration cycle apparatus 101 and the refrigerant storage portion 201 can be easily connected as compared with the refrigeration cycle system 1.

Third Embodiment (1) Overall Configuration

Figure 18:
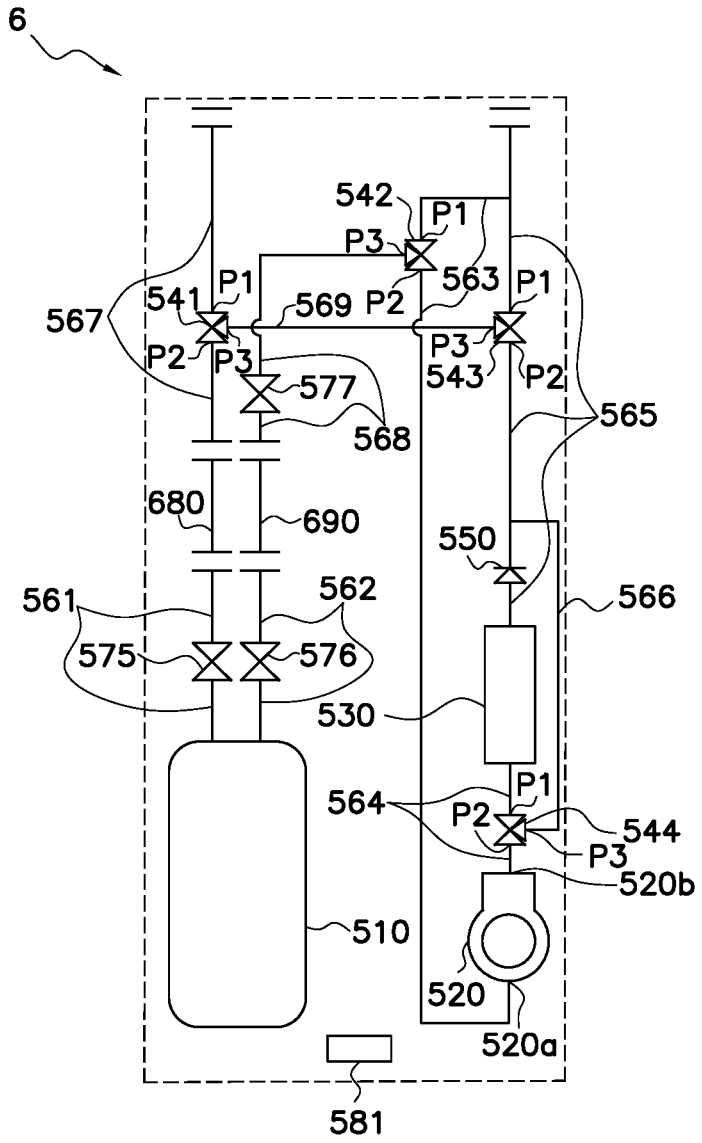
FIG. 18 is a schematic configuration diagram illustrating a refrigerant recovery apparatus 6.

A refrigerant recovery apparatus 6 according to a third embodiment of the present disclosure will be described focusing on different points from the refrigerant recovery apparatus 5. FIG. 18 is a schematic configuration diagram illustrating the refrigerant recovery apparatus 6.

The refrigerant recovery apparatus 6 has a recovery container 510, a second compressor 520, a heat exchanger 530, a switching valve 540, a check valve 550, a recovery apparatus pipe 560, a recovery apparatus on-off valve 570, a second control unit 581, and a refrigerant recovery connecting pipe 600.

Although details will be described later, the refrigerant recovery apparatus 6 is connected to a refrigeration cycle system 1 by a sixth refrigerant recovery connecting pipe 660 and a seventh refrigerant recovery connecting pipe 670 during a refrigerant recovery operation.

(2) Detailed Configuration (2-1) Refrigerant Recovery Connecting Pipe

The refrigerant recovery connecting pipe 600 includes an eighth refrigerant recovery connecting pipe 680 and a ninth refrigerant recovery connecting pipe 690.

(2-2) Switching Valve

The switching valve 540 includes a first switching valve 541, a second switching valve 542, a third switching valve 543, and a fourth switching valve 544.

(2-3) Recovery Apparatus On-Off Valve

The recovery apparatus on-off valve 570 includes a fifth recovery apparatus on-off valve 575, a sixth recovery apparatus on-off valve 576, and a seventh recovery apparatus on-off valve 577.

(2-4) Recovery Apparatus Pipe

The recovery apparatus pipe 560 includes: a first recovery apparatus pipe 561, a second recovery apparatus pipe 562, a third recovery apparatus pipe 563, a fourth recovery apparatus pipe 564, a fifth recovery apparatus pipe 565, a sixth recovery apparatus pipe 566, a seventh recovery apparatus pipe 567, an eighth recovery apparatus pipe 568, and a ninth recovery apparatus pipe 569.

One end of the first recovery apparatus pipe 561 is connected to the recovery container 510. Another end of the first recovery apparatus pipe 561 is connected to one end of the eighth refrigerant recovery connecting pipe 680. The first recovery apparatus pipe 561 is provided with the fifth recovery apparatus on-off valve 575.

One end of the second recovery apparatus pipe 562 is connected to the recovery container 510. Another end of the second recovery apparatus pipe 562 is connected to one end of the ninth refrigerant recovery connecting pipe 690. The second recovery apparatus pipe 562 is provided with the sixth recovery apparatus on-off valve 576.

One end of the third recovery apparatus pipe 563 is connected to the suction pipe 520*a* of the second compressor 520. Another end of the third recovery apparatus pipe 563 is connected between the third switching valve 543 and an end portion of the fifth recovery apparatus pipe 565 connected to the seventh refrigerant recovery connecting pipe 670. The third recovery apparatus pipe 563 is provided with the second switching valve 542. The third recovery apparatus pipe 563 is connected to a first port P1 and a second port P2 of the second switching valve 542. The second switching valve 542 causes the suction pipe 520*a* of the second compressor 520 to selectively communicate with the recovery container 510 and a refrigerant storage portion 200.

One end of the fourth recovery apparatus pipe 564 is connected to the discharge pipe 520*b* of the second compressor 520. Another end of the fourth recovery apparatus pipe 564 is connected to the heat exchanger 530. The fourth recovery apparatus pipe 564 is provided with the fourth switching valve 544. The fourth recovery apparatus pipe 564 is connected to a first port P1 and a second port P2 of the fourth switching valve 544.

One end of the fifth recovery apparatus pipe 565 is connected to another end of the heat exchanger 530. Another end of the fifth recovery apparatus pipe 565 is connected to the seventh refrigerant recovery connecting pipe 670 at a time of a refrigerant storage operation and a refrigerant filling operation. The fifth recovery apparatus pipe 565 is provided with the check valve 550 and the third switching valve 543 sequentially from the heat exchanger 530 side. The fifth recovery apparatus pipe 565 is connected to a first port P1 and a second port P2 of the third switching valve 543. The check valve 550 restricts a flow of a refrigerant from an end portion connected to the refrigerant recovery connecting pipe 600 to an end portion to which the heat exchanger 530 is connected, and allows a flow from the end portion to which the heat exchanger 530 is connected to the end portion connected to the refrigerant recovery connecting pipe 600. The third switching valve 543 causes the discharge pipe 520*b* of the second compressor 520 to selectively communicate with the first switching valve 541 and the refrigerant storage portion 200, via the heat exchanger 530 or the sixth recovery apparatus pipe 566.

One end of the sixth recovery apparatus pipe 566 is connected to a third port P3 of the fourth switching valve 544. Another end of the sixth recovery apparatus pipe 566 is connected between the third switching valve 543 and the check valve 550 in the fifth recovery apparatus pipe 565. The sixth recovery apparatus pipe 566 is connected in parallel to the heat exchanger 530.

One end of the seventh recovery apparatus pipe 567 is connected to the sixth refrigerant recovery connecting pipe 660 at a time of the refrigerant storage operation and the refrigerant filling operation. Another end of the seventh recovery apparatus pipe 567 is connected to the eighth refrigerant recovery connecting pipe 680. The seventh recovery apparatus pipe 567 is provided with the first switching valve 541. The seventh recovery apparatus pipe 567 is connected to a first port P1 and a second port P2 of the first switching valve 541. The first switching valve 541 causes the recovery container 510 to selectively communicate with the refrigerant storage portion 200 and the third switching valve 543.

One end of the eighth recovery apparatus pipe 568 is connected to a third port P3 of the second switching valve 542. Another end of the eighth recovery apparatus pipe 568 is connected to the ninth refrigerant recovery connecting pipe 690. The eighth recovery apparatus pipe 568 is provided with the seventh recovery apparatus on-off valve 577.

One end of the ninth recovery apparatus pipe 569 is connected to a third port P3 of the third switching valve 543. Another end of the ninth recovery apparatus pipe 569 is connected to a third port P3 of the first switching valve 541.

(2-5) Second Control Unit

The second control unit 581 controls operations of individual parts constituting the refrigeration cycle system 1 and the refrigerant recovery apparatus 6. The second control unit 581 is different from the second control unit 580 in a content of the refrigerant recovery operation executed by the second control unit 581. The refrigerant recovery operation executed by the second control unit 581 will be described later.

(3) Operation (3-1) Operation of Refrigerant Recovery Apparatus

The refrigerant recovery operation executed by the second control unit 581 of the refrigerant recovery apparatus 6 will be described.

(3-1-1) Refrigerant Recovery Operation

Figure 19:
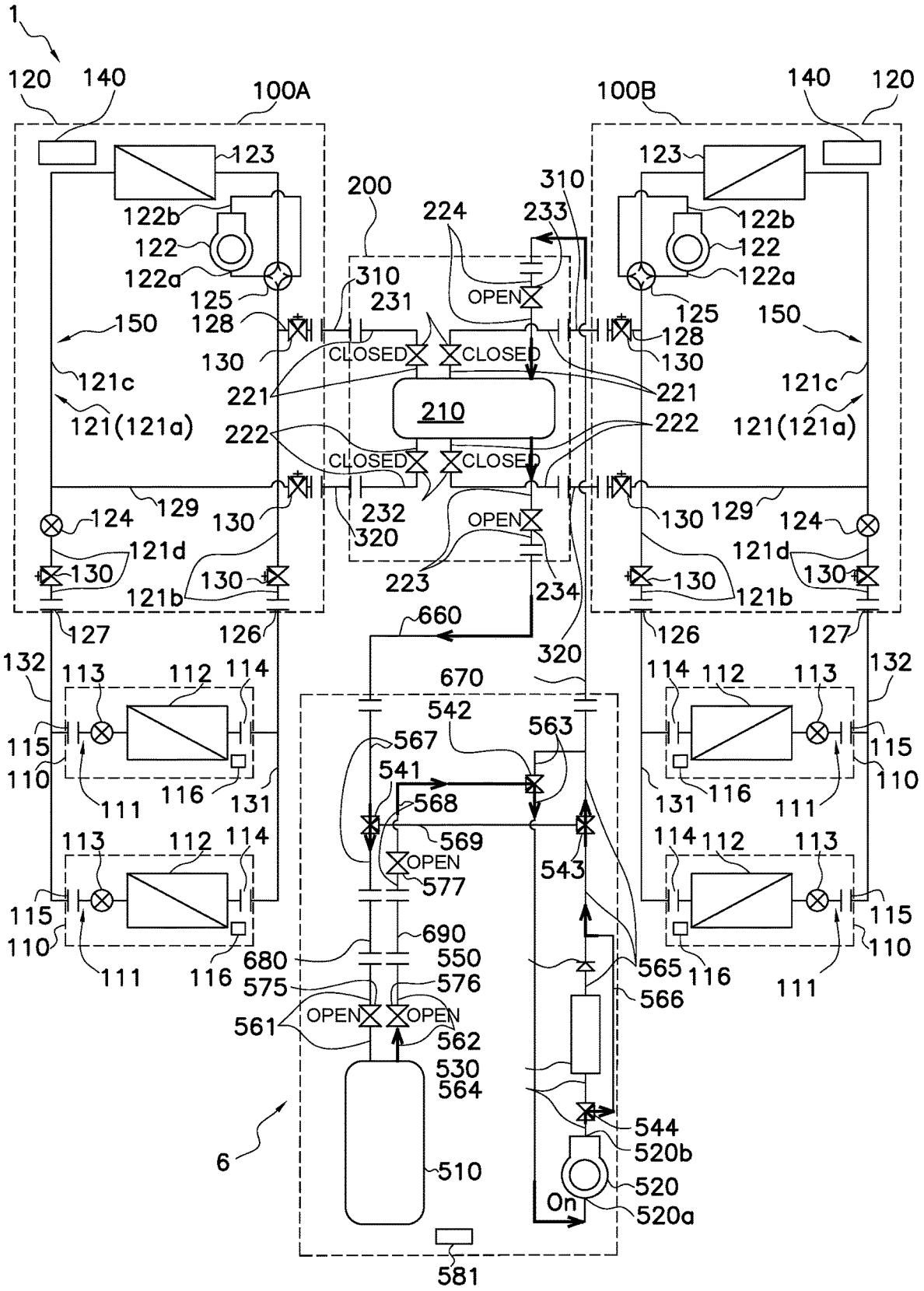
FIG. 19 is a schematic configuration diagram illustrating an operation of each device and a flow of a refrigerant during a first refrigerant recovery operation.
Figure 20:
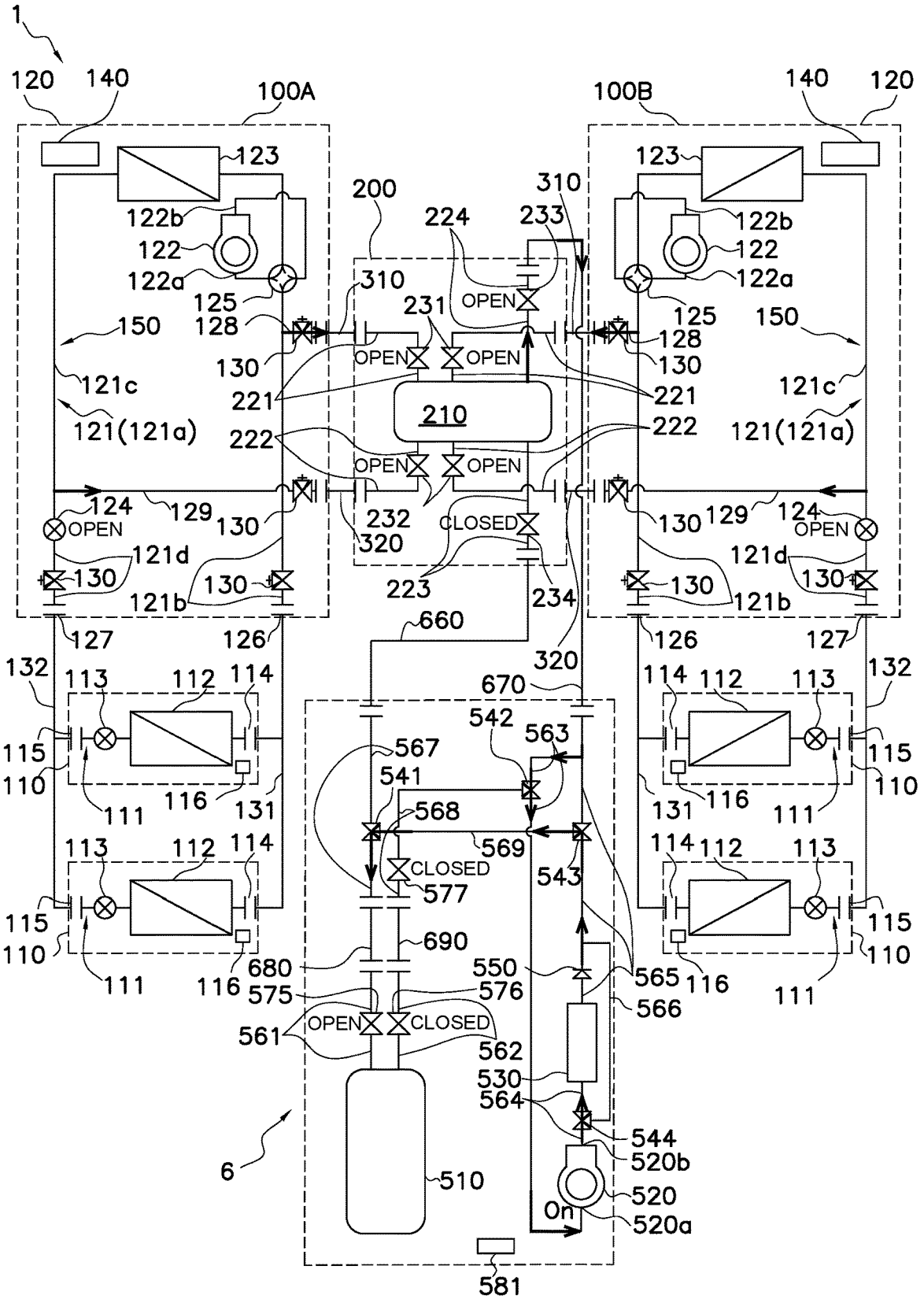
FIG. 20 is a schematic configuration diagram illustrating an operation of each device and a flow of a refrigerant during a second refrigerant recovery operation.

The refrigerant recovery operation includes a first refrigerant recovery operation and a second refrigerant recovery operation executed after an end of the first refrigerant recovery operation. FIG. 19 is a schematic configuration diagram illustrating an operation of each device and a flow of a refrigerant during the first refrigerant recovery operation. FIG. 20 is a schematic configuration diagram illustrating an operation of each device and a flow of a refrigerant during the second refrigerant recovery operation.

In executing the refrigerant recovery operation, the refrigeration cycle system 1 and the refrigerant recovery apparatus 6 are connected by the refrigerant recovery connecting pipe 600 as illustrated in FIGS. 19 and 20. Specifically, the seventh recovery apparatus pipe 567 is connected to the third storage portion pipe 223 by the sixth refrigerant recovery connecting pipe 660. The fifth recovery apparatus pipe 565 is connected to the fourth recovery apparatus pipe 564 by the seventh refrigerant recovery connecting pipe 670.

(First Refrigerant Recovery Operation)

In the first refrigerant recovery operation, for the refrigerant recovery apparatus 6, the second control unit 581 operates the second compressor 520, and sets the switching valve 540 to a predetermined state. Specifically, the second control unit 581 sets the first switching valve 541 to a first state, and sets a second switching valve 542 to a third state. The third switching valve 543 is set to the second state, and the fourth switching valve 544 is set to the third state. Accordingly, the first switching valve 541 causes the recovery container 510 to communicate with the refrigerant storage portion 200. The second switching valve 542 causes the suction pipe 520*a* of the second compressor 520 to communicate with the recovery container 510. The third switching valve 543 causes the discharge pipe 520*b* of the second compressor 520 to communicate with the refrigerant storage portion 200 via the sixth recovery apparatus pipe 566.

Further, the second control unit 581 sets all the recovery apparatus on-off valves 570 to an open state, for the refrigerant recovery apparatus 5. Further, for the refrigerant storage portion 200, the second control unit 581 sets a first storage portion on-off valve 231 and a second storage portion on-off valve 232 to a closed state, and sets a third storage portion on-off valve 233 and a fourth storage portion on-off valve 234 to an open state.

By executing the first refrigerant recovery operation, as indicated by an arrow in FIG. 19, a discharge pressure of the second compressor 520 of the refrigerant recovery apparatus 5 acts on a storage container 210, via the sixth recovery apparatus pipe 566, the fifth recovery apparatus pipe 565, the seventh refrigerant recovery connecting pipe 670, and the third storage portion pipe 223. The discharge pressure causes the refrigerant present inside the storage container 210 to be pushed out of the storage container 210 and recovered into the recovery container 510, via the fourth storage portion pipe 224, the sixth refrigerant recovery connecting pipe 660, the seventh recovery apparatus pipe 567, the eighth refrigerant recovery connecting pipe 680, and the first recovery apparatus pipe 561. Further, air inside the recovery container 510 is suctioned into the second compressor 520 from the suction pipe 520*a* via the second recovery apparatus pipe 562, the ninth refrigerant recovery connecting pipe 690, the eighth recovery apparatus pipe 568, and the third recovery apparatus pipe 563.

After executing the first refrigerant recovery operation for a predetermined time T6 set in advance, the second control unit 581 ends the first refrigerant recovery operation, and starts the second refrigerant recovery operation. The predetermined time T6 is set to, for example, a length that allows the liquid refrigerant inside the storage container 210 to be recovered into the recovery container 510.

(Second Refrigerant Recovery Operation)

In the second refrigerant recovery operation, for the refrigerant recovery apparatus 6, the second control unit 581 operates the second compressor 520, and causes predetermined ports of the switching valves 540 to communicate with each other. Specifically, the second control unit 581 sets the first switching valve 541 to the first state, sets the second switching valve 542 to the third state, sets the third switching valve 543 to the second state, and sets the fourth switching valve 544 to the third state. Accordingly, the first switching valve 541 causes the recovery container 510 to communicate with the third switching valve 543. The second switching valve 542 causes the suction pipe 520*a* of the second compressor 520 to communicate with the refrigerant storage portion 200. The third switching valve 543 causes the discharge pipe 520*b* of the second compressor 520 to communicate with the first switching valve 541 via the heat exchanger 530.

Further, the second control unit 581 sets an outdoor expansion mechanism 124 to an open state for all the refrigeration cycle apparatuses 100. Moreover, for the refrigerant recovery apparatus 5, the second control unit 581 sets the fifth recovery apparatus on-off valve 575 to an open state, and sets the sixth recovery apparatus on-off valve 576 and the seventh recovery apparatus on-off valve 577 to a closed state. The second control unit 581 sets storage portion on-off valves 230 other than the fourth storage portion on-off valve 234 to an open state, for the refrigerant storage portion 200.

By executing the second refrigerant recovery operation, as indicated by an arrow in FIG. 20, a suction pressure of the second compressor 520 of the refrigerant recovery apparatus 5 acts on the storage container 210, via the third recovery apparatus pipe 563, the seventh refrigerant recovery connecting pipe 670, and the third storage portion pipe 223. The suction pressure acting on the storage container 210 further acts on a refrigerant circulation path 150 via the first storage portion pipe 221, the gas-side branch pipe 128, the second storage portion pipe 222, and a liquid-side branch pipe 129. The action of the suction pressure causes the refrigerant present inside the refrigerant circulation path 150 to flow into the storage container 210, via the first storage portion pipe 221, the gas-side branch pipe 128, the second storage portion pipe 222, and the liquid-side branch pipe 129. The refrigerant having flowed into the storage container 210 flows into the refrigerant recovery apparatus 5 from the third recovery apparatus pipe 563, via the fourth refrigerant recovery connecting pipe 640. The refrigerant having flowed into the refrigerant recovery apparatus 5 is suctioned into the second compressor 520. The refrigerant discharged from the second compressor 520 passes through the fourth recovery apparatus pipe 564, the heat exchanger 530, the fifth recovery apparatus pipe 565, the ninth recovery apparatus pipe 569, the seventh recovery apparatus pipe 567, the eighth refrigerant recovery connecting pipe 680, and the first recovery apparatus pipe 561, and is recovered into the recovery container 510.

After executing the second refrigerant recovery operation for a predetermined time T7 set in advance, the second control unit 581 ends the second refrigerant recovery operation. The predetermined time T7 is set to, for example, a length that allows the refrigerant present inside the refrigerant circulation path 150 of the refrigeration cycle system 1 to be recovered into the recovery container 510.

(4) Features 4-1

The refrigerant recovery apparatus 6 further includes the first switching valve 541, the second switching valve 542, and the third switching valve 543. The first switching valve 541 causes the recovery container 510 to selectively communicate with the refrigerant storage portion 200 and the third switching valve 543. The second switching valve 542 causes the suction pipe 520*a* of the second compressor 520 to selectively communicate with the recovery container 510 and the refrigerant storage portion 200. The third switching valve 543 causes the discharge pipe 520*b* of the second compressor 520 to selectively communicate with the first switching valve 541 and the refrigerant storage portion 200.

In the first refrigerant recovery operation, the second control unit 581 controls the first switching valve 541 to cause the recovery container 510 to communicate with the refrigerant storage portion 200, controls the second switching valve 542 to cause the suction pipe 520*a* of the second compressor 520 to communicate with the recovery container 510, and controls the third switching valve 543 to cause the discharge pipe 520*b* of the second compressor 520 to communicate with the refrigerant storage portion 200.

In the second refrigerant recovery operation, the second control unit 581 controls the first switching valve 541 to cause the recovery container 510 to communicate with the third switching valve 543, controls the second switching valve 542 to cause the suction pipe 520*a* of the second compressor 520 to communicate with the refrigerant storage portion 200, and controls the third switching valve 543 to cause the discharge pipe 520*b* of the second compressor 520 to communicate with the first switching valve 541.

This feature enables the refrigerant recovery apparatus 6 to change communication between the recovery container 510, the refrigerant storage portion 200, and the second compressor 520 only by switching the switching valve 540. Therefore, in the refrigerant recovery apparatus 6, it is not necessary to change connection of the refrigerant recovery connecting pipe 600 at a time of executing the second refrigerant recovery operation after an end of the first refrigerant recovery operation. Accordingly, the second control unit 581 can continuously and automatically execute the first refrigerant recovery operation and the second refrigerant recovery operation.

The embodiments of the present disclosure have been described above. It will be understood that various changes to modes and details can be made without departing from the spirit and scope of the present disclosure recited in the claims.

REFERENCE SIGNS LIST

1, 2: refrigeration cycle system
5, 6: refrigerant recovery apparatus
100 (100*a*, 100*b*): refrigeration cycle apparatus
110: indoor unit
111: indoor refrigerant flow path
112: indoor heat exchanger
116: detection unit
120: outdoor unit
121: outdoor refrigerant flow path
121*b*: first refrigerant pipe
121*c*: second refrigerant pipe
121*d*: third refrigerant pipe
122: first compressor
123: outdoor heat exchanger
124: outdoor expansion mechanism
125: flow path switching mechanism
126: gas-side connecting portion
127: liquid-side connecting portion
128: gas-side branch pipe

129: liquid-side branch pipe
130: outdoor refrigerant flow path shutoff valve
131: gas-side connection pipe
132: liquid-side connection pipe
140: first control unit
150: refrigerant circulation path
200: refrigerant storage portion
220: storage portion pipe
221 to 224: first to fourth storage portion pipes
230: storage portion on-off valve
231 to 234: first to fourth storage portion on-off valves
241: check valve
242: decompressor
250: expansion mechanism
300: connection communication pipe
510: recovery container
520: second compressor
520*a*: suction pipe
520*b*: discharge pipe
540: switching valve
541 to 543: first to third switching valves
580: second control unit

CITATION LIST

Patent Literature

Patent Literature 1: JP H10-009692 A

The invention claimed is:

1. A refrigeration cycle system comprising:

a refrigeration cycle apparatus including an indoor unit having an indoor refrigerant flow path, an outdoor unit having an outdoor refrigerant flow path, and a gas-side connection pipe and a liquid-side connection pipe that connect the indoor refrigerant flow path and the outdoor refrigerant flow path; and a refrigerant storage portion that stores a refrigerant present inside a refrigerant circulation path formed by the indoor refrigerant flow path, the outdoor refrigerant flow path, the gas-side connection pipe, and the liquid-side connection pipe, wherein the outdoor refrigerant flow path has a first compressor, an outdoor heat exchanger, an outdoor expansion mechanism, a flow path switching mechanism, a gas-side connecting portion to which the gas-side connection pipe is connected, a liquid-side connecting portion to which the liquid-side connection pipe is connected, a first refrigerant pipe that connects the flow path switching mechanism and the gas-side connecting portion, a second refrigerant pipe that connects the outdoor heat exchanger and the outdoor expansion mechanism, and a third refrigerant pipe that connects the outdoor expansion mechanism and the liquid-side connecting portion, the refrigerant storage portion communicates with the refrigerant circulation path through a first pipe and a second pipe, the first pipe connects the first refrigerant pipe and the refrigerant storage portion to communicate with each other, or causes the gas-side connection pipe and the refrigerant storage portion to communicate with each other, and the second pipe connects the second refrigerant pipe and the refrigerant storage portion to communicate with each other.

2. The refrigeration cycle system according to claim 1, comprising a plurality of the refrigeration cycle apparatuses.

3. The refrigeration cycle system according to claim 1, wherein the refrigeration cycle apparatus has a plurality of the indoor units.

4. The refrigeration cycle system according to claim 1, further comprising a first on-off valve and a second on-off valve, wherein the first on-off valve allows or interrupts a flow of the refrigerant between the first refrigerant pipe and the refrigerant storage portion or between the gas-side connection pipe and the refrigerant storage portion, and the second on-off valve allows or interrupts a flow of the refrigerant between the second refrigerant pipe and the refrigerant storage portion.

5. The refrigeration cycle system according to claim 4, further comprising a first controller that controls the first compressor, the outdoor expansion mechanism, and the flow path switching mechanism, wherein the flow path switching mechanism takes a first state of causing the outdoor heat exchanger to function as a condenser or a second state of causing the outdoor heat exchanger to function as an evaporator, and the first controller executes first control of setting the flow path switching mechanism to the first state, setting the outdoor expansion mechanism to a closed state, and operating the first compressor to store the refrigerant into the refrigerant storage portion, and executes second control of operating the first compressor, setting the first on-off valve to an open state, and storing a gas refrigerant into the refrigerant storage portion, when the first control ends.

6. The refrigeration cycle system according to claim 5, wherein the first controller executes third control of setting the flow path switching mechanism to the second state, setting the outdoor expansion mechanism to an open state, and operating the first compressor to fill the refrigerant circulation path with the refrigerant present inside the refrigerant storage portion.

7. The refrigeration cycle system according to claim 6, wherein the second pipe has:

a check valve that restricts a flow of the refrigerant from the refrigerant storage portion to the outdoor refrigerant flow path; and a decompressor provided in parallel with the check valve.

8. The refrigeration cycle system according to claim 1, wherein the second pipe has an expansion mechanism that is fully closable.

9. The refrigeration cycle system according to claim 1, wherein the outdoor unit further has a liquid-side branch pipe connected to the second refrigerant pipe, and the second pipe communicates with the liquid-side branch pipe.

10. The refrigeration cycle system according to claim 9, wherein the outdoor unit further has a gas-side branch pipe connected to the first refrigerant pipe, and the first pipe communicates with the gas-side branch pipe.

11. The refrigeration cycle system according to claim 10, wherein the first pipe is connected to the gas-side connecting portion.

12. The refrigeration cycle system according to claim 10, wherein the outdoor unit further has four outdoor refrigerant flow path shutoff valves, and each of the outdoor refrigerant flow path shutoff valves allows or interrupts communication of the outdoor refrigerant flow path, and is provided in the first refrigerant pipe, the third refrigerant pipe, the gas-side branch pipe, and the liquid-side branch pipe.

13. The refrigeration cycle system according to claim 10, wherein the outdoor unit further has three outdoor refrigerant flow path shutoff valves, and each of the outdoor refrigerant flow path shutoff valves allows or interrupts communication of the outdoor refrigerant flow path, and is provided between the flow path switching mechanism of the first refrigerant pipe and a connection point of the gas-side branch pipe, and provided in the third refrigerant pipe and the liquid-side branch pipe.

14. The refrigeration cycle system according to claim 10, wherein the outdoor unit further has two outdoor refrigerant flow path shutoff valves, and each of the outdoor refrigerant flow path shutoff valves allows or interrupts communication of the outdoor refrigerant flow path, and is provided between the flow path switching mechanism of the first refrigerant pipe and a connection point of the gas-side branch pipe, and between the outdoor heat exchanger of the second refrigerant pipe and a connection point of the liquid-side branch pipe.

15. The refrigeration cycle system according to claim 5, wherein the indoor refrigerant flow path has an indoor heat exchanger, the indoor unit has a detection unit that detects leakage of the refrigerant, and the first controller executes the first control after the detection unit detects leakage of the refrigerant.

16. The refrigeration cycle system according to claim 1, wherein the refrigerant has flammability or toxicity.

17. A refrigerant recovery apparatus for recovering a refrigerant of the refrigeration cycle system according to claim 1, the refrigerant recovery apparatus comprising:

a recovery container that contains the refrigerant;

a second compressor that applies a predetermined pressure to an inside of the refrigerant storage portion of the refrigeration cycle system; and a second controller that controls the second compressor, wherein the second controller controls the second compressor to recover the refrigerant present in a refrigerant circulation path of the refrigeration cycle system into the recovery container.

18. The refrigerant recovery apparatus according to claim 17, wherein the second controller executes fourth control of controlling the second compressor to apply a discharge pressure of the second compressor to an inside of the refrigerant storage portion, and causing the refrigerant to flow into the recovery container, and executes fifth control of controlling the second compressor to apply a suction pressure of the second compressor to an inside of the refrigerant storage portion, and causing the refrigerant to flow into the recovery container, when the fourth control ends.

19. The refrigerant recovery apparatus according to claim 17, further comprising:

a first switching valve;

a second switching valve; and a third switching valve, wherein the first switching valve causes the recovery container to selectively communicate with the refrigerant storage portion and the third switching valve, the second switching valve causes a suction side of the second compressor to selectively communicate with the recovery container and the refrigerant storage portion, the third switching valve causes a discharge side of the second compressor to selectively communicate with the first switching valve and the refrigerant storage portion, and the second controller controls the first switching valve to cause the recovery container to communicate with the refrigerant storage portion, controls the second switching valve to cause the suction side of the second compressor to communicate with the recovery container, and controls the third switching valve to cause the discharge side of the second compressor to communicate with the refrigerant storage portion, in the fourth control, and controls the first switching valve to cause the recovery container to communicate with the third switching valve, controls the second switching valve to cause the suction side of the second compressor to communicate with the refrigerant storage portion, and controls the third switching valve to cause the discharge side of the second compressor to communicate with the first switching valve, in the fifth control.

20. The refrigeration cycle system according to claim 1, wherein the flow path switching mechanism is set to a first state of causing the outdoor heat exchanger to function as a condenser, the outdoor expansion mechanism is set to a closed state, and the refrigerant is stored in the refrigerant storage portion by operating the first compressor.

* * * * *